US009613501B2

(12) United States Patent
Hoffman et al.

(10) Patent No.: US 9,613,501 B2
(45) Date of Patent: Apr. 4, 2017

(54) SINGLE REEL GAME METHOD, DEVICE AND SYSTEM

(71) Applicants: Benjamin Cramblet Hoffman, Reno, NV (US); Joseph Gerard Berger, Reno, NV (US); Farhad Ahmadzai, Reno, NV (US); Jason Benjamin Newmark, Reno, NV (US); William Frederick Burrows, Reno, NV (US); Lucas Andrew Munns, Reno, NV (US)

(72) Inventors: Benjamin Cramblet Hoffman, Reno, NV (US); Joseph Gerard Berger, Reno, NV (US); Farhad Ahmadzai, Reno, NV (US); Jason Benjamin Newmark, Reno, NV (US); William Frederick Burrows, Reno, NV (US); Lucas Andrew Munns, Reno, NV (US)

(73) Assignee: URSA Major Media, Inc., Reno, NV (US)

( * ) Notice: Subject to any disclaimer, the term of this patent is extended or adjusted under 35 U.S.C. 154(b) by 247 days.

(21) Appl. No.: 14/172,772

(22) Filed: Feb. 4, 2014

(65) Prior Publication Data

US 2014/0243069 A1 Aug. 28, 2014

Related U.S. Application Data

(60) Provisional application No. 61/769,929, filed on Feb. 27, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3265* (2013.01)

(58) Field of Classification Search
USPC ..... 473/21–23; 463/16–25
See application file for complete search history.

(56) References Cited

U.S. PATENT DOCUMENTS 8,911,298 B2 * 12/2014 Li ..... F16D 7/044 464/39
2009/0275391 A1 * 11/2009 Langille ..... G07F 17/34 463/20
2010/0234089 A1 * 9/2010 Saffari ..... G07F 17/34 463/20
2010/0234091 A1 * 9/2010 Baerlocher ..... G07F 17/34 463/20
2014/0087820 A1 * 3/2014 Brune ..... G07F 17/3262 463/20

* cited by examiner

*Primary Examiner* — Ronald Laneau
(74) *Attorney, Agent, or Firm* — Fennemore Craig, P.C.

(57) ABSTRACT

A single reel game includes a single reel having a plurality of symbols that are adjacent to one another. The single reel then moves and follows a track that displays the symbols in a spatial order. The single reel is then stopped at a starting reel stop that provides a reference point for stopping the single reel. A win window displays the plurality of the single reel symbols. A payline is then overlaid on the symbols within the win window. The single reel game also includes a paytable that lists a plurality of payout prizes for each combination of symbols along the payline. A prize is awarded when the single reel game symbols along the payline match the paytable combination of symbols.

19 Claims, 36 Drawing Sheets

Example of reel-to-win-window mapping:

• Starting with reel stop 1

20a

| | | | | | | |
|---|---|---|---|---|---|---|
| | Win Window | | | | | 1 |
| 8 | 7 | 6 | 5 | 4 | 3 | 2 |
| 9 | 10 | 11 | 12 | 13 | 14 | 15 |
| 22 | 21 | 20 | 19 | 18 | 17 | 16 |
| 23 | | | | | | |

Figure 1C

Example of reel-to-win-window mapping:

• Starting with reel stop 48

20b

| | | | | | | |
|---|---|---|---|---|---|---|
| | Win Window | | | | | 48 |
| 55 | 54 | 53 | 52 | 51 | 50 | 49 |
| 56 | 57 | 58 | 59 | 60 | 61 | 62 |
| 69 | 68 | 67 | 66 | 65 | 64 | 63 |
| 70 | | | | | | |

Figure 1D

SINGLE REEL GAME METHOD, DEVICE AND SYSTEM

CROSS REFERENCE

This patent application claims the benefit of provisional patent application 61/769,929 filed on Feb. 27, 2013 and entitled SINGLE REEL GAME HAVING RANDOM OUTCOMES, which is hereby incorporated by reference.

FIELD

The present invention relates to a single reel game that generates random game outcomes. More specifically, the single reel game may be embodied as a primary game or bonus game in a gaming device or a gaming system.

BACKGROUND

Typically, gaming devices such as slot machines operate with a plurality of reels, in which each reel includes a plurality of symbols. In a slot machine reel game, the player causes the reels to spin by placing a wager on the game. The outcome provided to the betting player for win evaluation is generated by a series of three to five reels that spin vertically until they stop. The resulting game mechanic is such that the set of possible wager outcomes is made up of all of the combinations of reel stops from all of the reels involved.

Generally, slot machines in the United States are divided into two class types that are described as "Class III" and "Class II." The Class III slot machines use an individual internal random number generator to determine wins and losses. Class III slot machines also include reel spins that are separate from one another and machines that are not linked to a paytable. In Class III machines, the player is playing against the house and not against other opponents. Additionally, for Class III slot machines the wins are instant and immediately payable.

Class II slot machines are tied to a centralized random number generator that is communicatively coupled to a connected group of machines. The individual Class II slot machine does not determine whether the player wins or loses. The Class II slot machine is part of a networked game and players compete against each other for a central prize pool. When a new game commences, there are a set and limited number of outcomes until the sequence is complete and the game resets.

Generally, a player is awarded a prize when a generated symbol or combination of symbols appears along an active payline. In addition to paylines, there are other methods to award a player that include a "nudge" feature. A "nudge" occurs after the reels initially spin and stop. The "nudge" allows the game or the player to move the reels through a limited rotation from a first position "non-winning" position to a second position that is a "possibly winning position."

Another method for awarding a player includes a gaming device with multiple individual reels that allow the manipulation of the position of the symbols on the reels. These symbols may be manipulated across the multiple reels in a variety of ways after a reel stop. This primary game manipulation may increase the number of combinations presented to the player and thereby increase the player's chance of achieving winning combinations. For example, when the player spins the reels and the reels stop, an evaluation of the win lines is performed and a "shuffle bonus" is initiated that rearranges the symbols already on screen to provide new combinations on the paylines.

SUMMARY

A method for operating a single reel game in a single reel gaming device is presented. The single reel game includes a single reel having a plurality of symbols that are adjacent to one another. The single reel then moves and follows a track that displays the symbols in a spatial order. The single reel is then stopped at a starting reel stop that provides a reference point for stopping the single reel. A win window displays the plurality of the single reel symbols. A payline is then overlaid on the symbols within the win window. The single reel game also includes a paytable that lists a plurality of payout prizes for each combination of symbols along the payline. A prize is awarded when the single reel game symbols along the payline match the paytable combination of symbols.

In the gaming device embodiment, a processor is configured to perform the single reel game operations. Additionally, the gaming device includes a network card that is communicatively coupled to a network so the gaming device is configured to communicate with the network.

Furthermore, a single reel gaming system is described. The gaming system includes a gaming server and a gaming client. More particularly, the gaming server includes a single reel module configured to generate and deliver a single reel that includes a plurality of symbols that are adjacent to one another, a track that displays the symbols in a spatial order, a starting reel stop that provides a reference point for stopping the single reel when the single reel is in motion, a win window that displays a plurality of the single reel symbols that fall within the win window, a payline that is overlaid on the symbols within the win window, and a paytable that lists a plurality of payout prizes for each combination of symbols along the payline. The gaming client includes a game session input that is communicated to the gaming server that stops the single reel at the starting reel stop according to the random game output module, and a display that presents a single reel game outcome. In the single reel gaming system, a prize is awarded when the single reel game symbols along the payline match the paytable combination of symbols.

In one illustrative embodiment, the single reel game includes a consecutive reel stop function, in which all the symbols in the win window are populated by consecutive stops from the single reel game. In another illustrative embodiment, the single reel game includes a non-consecutive reel stop population function, in which reel stops in the single reel population are positioned outside of the win window.

In yet another illustrative embodiment, the single reel track includes an overlapping track, in which the single reel track overlaps in at least one reel stop. The track may also include at least one track branch point, in which a track branches into two branched tracks.

FIGURES

The present invention will be more fully understood by reference to the following drawings which are for illustrative, not limiting, purposes.

FIG. 1C shows an illustrative win window with a starting reel stop of 1.

FIG. 1D shows an illustrative win window with a starting reel stop of 48.

DESCRIPTION

Figure 1A:
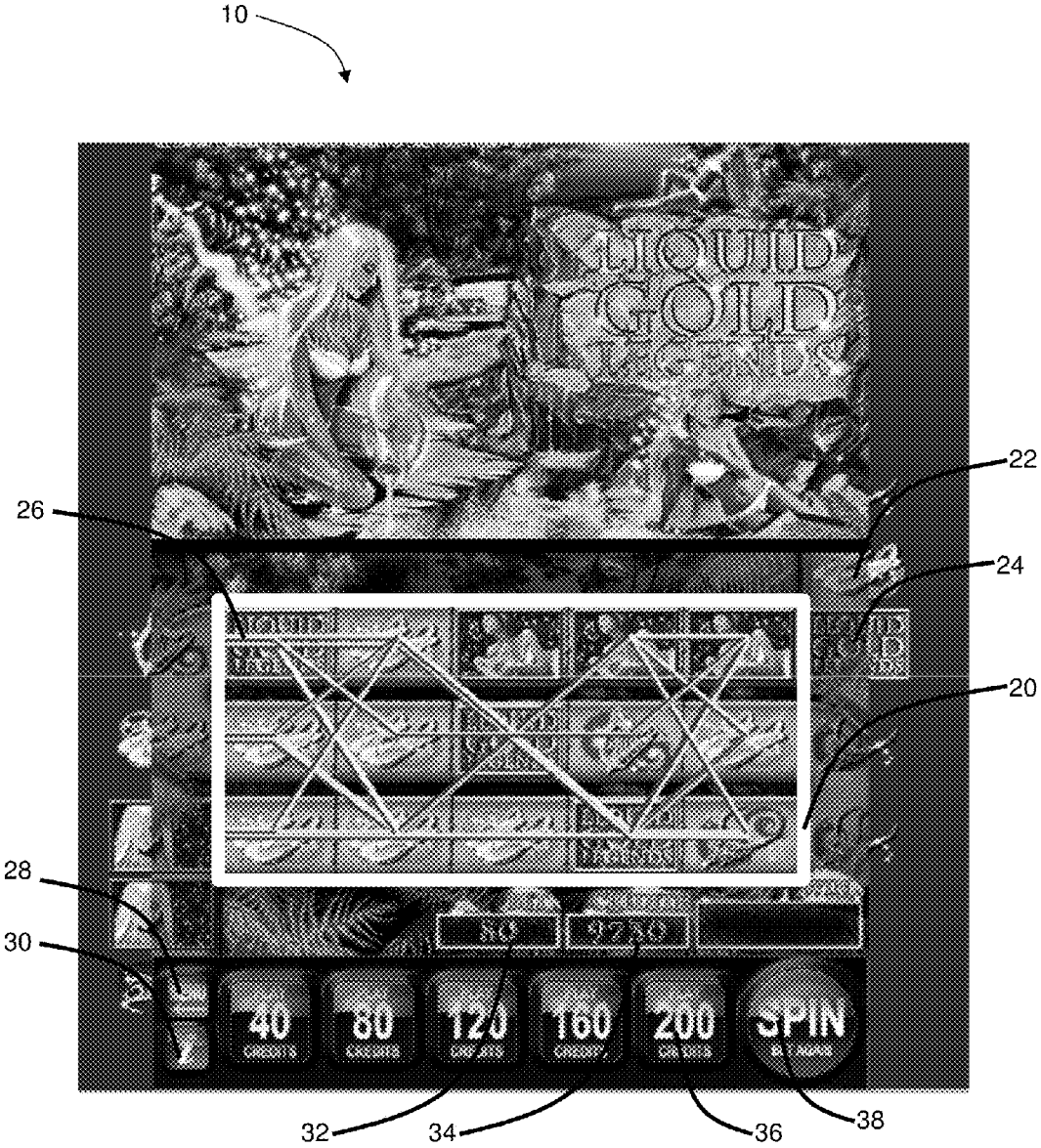
FIG. 1A shows a game outcome for an illustrative game entitled "LIQUID GOLD LEGENDS."

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the game or games, gaming devices, gaming systems and gaming methods described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims.

A single reel game, a single reel game device, and a single reel gaming system are described herein. The single reel game includes a set of continuous symbols on one single reel that populate a win window, in which the single reel follows a series of pre-determined patterns. The single reel may populate the win window with symbols having various shapes, patterns, and sizes. Paylines are then overlaid on the win windows to determine whether a prize is awarded for the random outcome. The single reel game includes a single reel win window or list of symbols win window that folds or flexes the single reel (or list of symbols in the single reel) so that the numbers or symbols traveling on the single reel do not follow a straight path with respect to the grid of the win window.

The single reel game that generates random game outcomes may also be referred to as a UNIREEL™ game, and the names "single reel" game and "UNIREEL" game may be used interchangeably for purposes of this patent application filing and the provisional patent application 61/769,929 that is incorporated by reference. In general, the single reel game described herein may be applied to a primary game or a bonus game.

A primary game session refers to a game session that includes more than one game event that corresponds to a primary game or "base" game, which are used interchangeably in this patent. The primary game session yields a game event such as a random game outcome. Another illustrative game event initiates the primary game session when a wager or credits are received or transferred to the game. The primary game session may also be initiated by other game events including, but not limited to, a player hitting a spin button, a start button, a deal button, or any other such input indicating that the player is desirous of starting the primary game session. The primary game session may be terminated voluntarily when the player elects to stop the game, or involuntarily when the gaming device terminates the primary game session based on a termination event.

As used herein, the terms "bonus game," "secondary game," "bonus game session," refer generally to a game or a component of a game involving procedures in addition to the primary game. Typically, the bonus game session is initiated after the primary game session and only after a particular condition has been triggered or satisfied that causes the bonus game session to be initiated. The bonus game session may also include a plurality of bonus game events.

For example, when the illustrative primary game includes a slot game, the bonus game may allow players the possibility of winning more than the pay table indicates. Typically, the bonus game outcome depends upon the outcome of the primary game. For example, a bonus game outcome may depend upon a particular symbol being displayed on a slot reel when one of final game events take place. Also, the bonus game outcome may depend upon winning a payout from a slot game play while the gaming machine is in a "bonus zone." In other embodiments, the bonus game may be unconnected with the outcome of a primary game play.

More generally, the single reel game presented herein includes a win window that may be applied in a variety of ways. The most basic and straightforward use of the single reel game is as a primary game or "base game," that includes a win window population. Alternatively, the single reel game functionality may also be deployed solely as a bonus mechanism.

A variety of different game "features" may also be built from the single reel game technology and include "special" symbols as described below in further detail, e.g. FIG. 26 and FIG. 27. In other applications, the UNIREEL™ feature supplies both a base game and bonus game mechanic, or base game and feature mechanic, or any other combination of base game, base game feature, and bonus.

The illustrative single reel embodiments presented herein may also be generally referred to as a "game feature." For example, the single reel game feature may be applied in a Class II central determination game, in which the game outcomes for multiple client games are determined on a single server. Additionally, the single game feature may be applied on a Class III game-by-game basis where the game outcomes are determined by the individual games. The single reel game feature may also include a set of possible outcomes used in a Class II scenario that could include the entire combinatorial cycle for a primary game, as embodied in a Class III scenario. In other words, a single reel game designed for Class III may require less alteration to be transformed into a game for Class II than traditional multiple-reel games require.

Referring to FIG. 1A, there is shown a game outcome for an illustrative single reel game entitled "LIQUID GOLD LEGENDS." The illustrative single reel game 10 has a sirens theme, in which the "win window," the type of "stop," the "track shape," and the "track starting point" that may be used to control the illustrative single reel game deployment. These illustrative variables are applied in illustrative FIG. 1B.

Figure 1B:
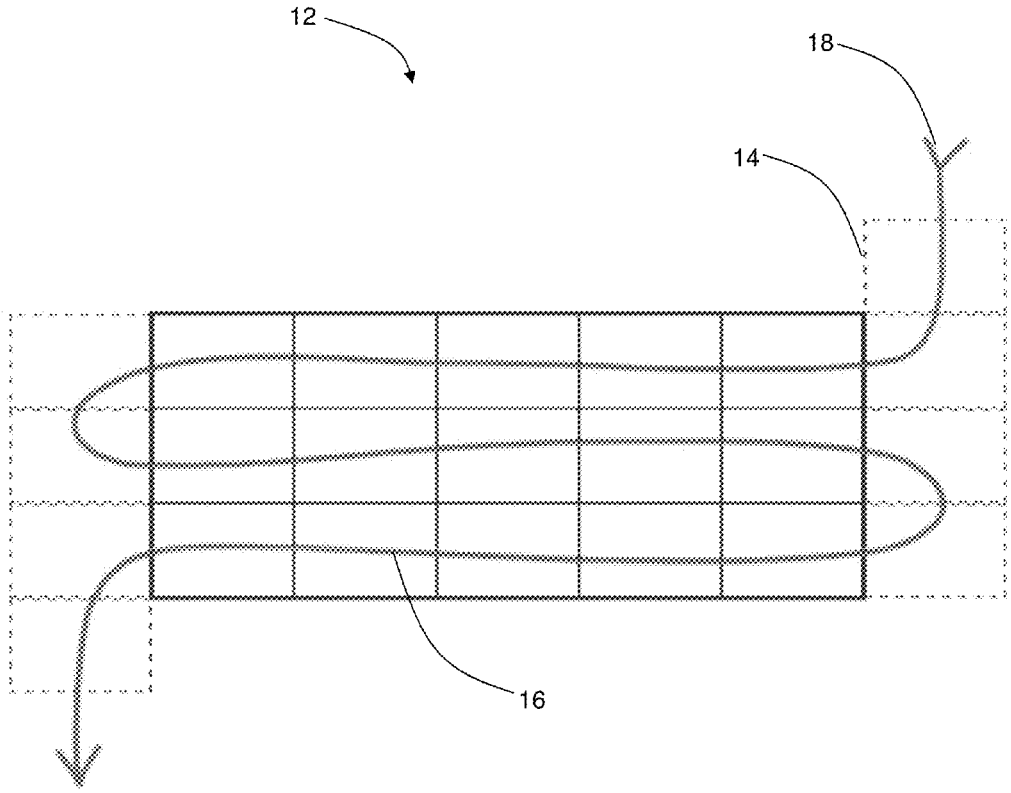
FIG. 1B shows further detail of one illustrative single reel game deployment of FIG. 1A.

Referring to FIG. 1B, there is shown further detail of one illustrative single reel game deployment of FIG. 1A with further emphasis on the win window, the type of stop, and the track shape. More specifically, a 3×5 win window layout 12 with non-consecutive reel stop population 14, a horizontal snake track shape 16, an upper right track starting point 18. Additionally, there are no overlapping tracks and no track branching in the illustrative single reel game 12.

Returning to FIG. 1A, the illustrative single reel game 10 also includes a win window 20 having a 3×5 grid of symbols. The illustrative single reel game 10 includes a single reel 22 that is folded so that symbols 24 travel from right to left on the top row, from left to right on the middle row, and from right to left on the bottom row. The figure shows symbols 24 in a continuous line. Also shown are the paylines 26, which indicate potential winning lines in the game.

The single reel game includes a single reel that includes a plurality of symbols that are adjacent to one another. The single reel then moves and follows a track that displays the symbols in a spatial order. The single reel is then stopped at a starting reel stop that provides a reference point for stopping the single reel. A win window displays the plurality of the single reel symbols. A payline is then overlaid on the symbols within the win window. The single reel game also includes a paytable that lists a plurality of payout prizes for each combination of symbols along the payline. A prize is awarded when the single reel game symbols along the payline match the paytable combination of symbols.

The game also includes a menu button 28 and an information button 30 to provide help to the player. Also displayed are the amount bet by the player 32 and remaining credits available 34. The game also has instant play credit selector buttons 36 and a start spin button 38.

Referring now to FIG. 1C and FIG. 1D, there is shown a diagram that displays how the single reel is mapped to an illustrative win window 20*a* in the illustrative single reel game of FIG. 1A. More particularly, FIG. 1C presents illustrative win window 20*a* with a starting reel stop of 1. A reel stop is one single position on the reel of the slot machine. The illustrative win window 20*a* includes 7, 6, 5, 4 and 3 for the top row; 10, 11, 12, 13, and 14 for the middle row; and 21, 20, 19, 18 and 17 for the bottom row. Of particular importance is that the numbers outside the illustrative win window 20*a* are not used to determine whether the player is awarded a prize. More specifically, the numbers on the left column, i.e. 8, 9, 22 and 23, and the numbers on the right column, i.e. 1, 2, 15 and 16, are not used to determine whether to award a prize to the player.

In FIG. 1D there is shown another illustrative win window 20*b* with a starting reel stop of 48, in which the win window 20*b* includes 54, 53, 52, 51 and 50 for the top row of the win window; 57, 58, 59, 60, and 61 for the middle row of the win window; and 68, 67, 66, 65 and 64 for the bottom row.

Figure 1E:
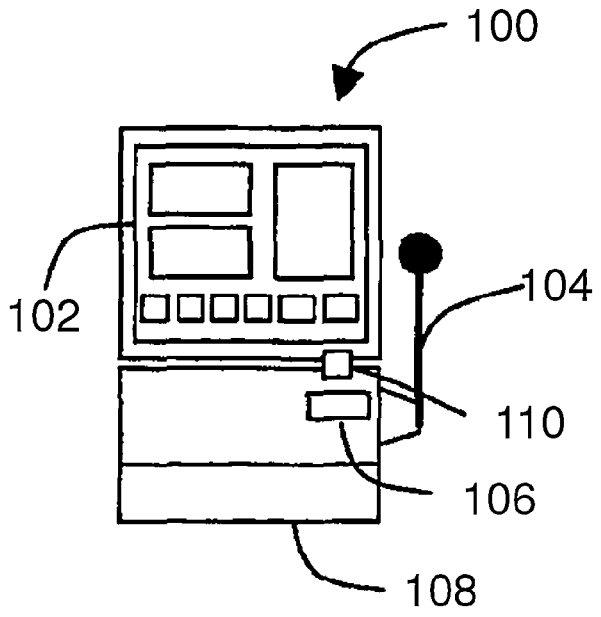
FIG. 1E shows an illustrative stand-alone electronic device configured to operate the illustrative single reel game embodiments presented herein.

Referring now to FIG. 1E, there is shown an illustrative stand alone gaming device 100 configured to operate the illustrative single red game embodiment presented herein. In the illustrative embodiment, the stand-alone gaming device 100 is an electronic device that has a touch screen video display 102 that displays a player interface. Other electronic devices that could be used to provide an interactive gaming experience include a computer having interactive gaming software, a personal digital assistant, a mobile phone, a smartphone, or any other such device or combination of devices that displays the interactive game. As shown, the illustrative stand alone gaming device 100 may include a handle 104 that acts as a player interface component.

Additionally, the illustrative stand alone device 100 includes a monetary input component that is configured to receive money or transferable credits, respectively. The illustrative monetary input component 106 is a device configured to receive Ticket In Ticket Out (TITO) tickets, coupons, cash, a credit card, debit card or other such instruments that can transfer money or credits. Additionally, the illustrative monetary input component 106 may also be configured to receive transferable credits from an e-wallet on a smartphone. The transferable credits may be provided by a coupon based system.

The communications module 108 includes various communication channels that can utilize Ethernet, I2C, RS-232, USB, RS-485, IEEE 1394, Netplex and other standard or proprietary communication interfaces used in the gaming industry. These communication channels may operate or interface with wired and wireless communications channels. The communications module 108 may be used to communicate with personal communication devices such as smartphones that operate using Bluetooth wireless technology, Wi-Fi, or other such technologies that enable communications between the electronic gaming device and the personal communication device.

Additionally, the illustrative gaming device may also include other input and output devices 110 such as input buttons, bill validators, card readers, printers, displays, audio devices, bonus devices (e.g., wheels and reels), or lighting devices that are used to provide a wager-based game on the gaming machine. The input and output devices 110 are typically related to distributing awards and include a paper coupon, a smart card, a magnetic stripe card, or any other such means that can record the transfer of money or credits to the player.

Figure 1F:
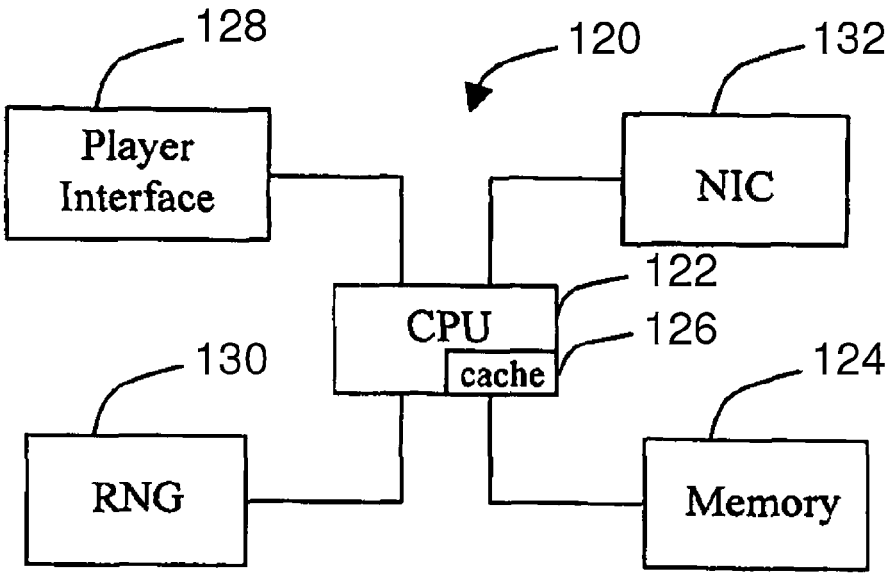
FIG. 1F shows an illustrative block diagram of the system components of the stand alone gaming device in FIG. 1E.

Referring now to FIG. 1F, there is shown a simplified illustrative block diagram of the illustrative system components 120 of the stand alone gaming device 100. The system components 120 include a logic component that is operatively coupled to internal components that manage the various gaming systems and operations for the interactive gaming device 100. In one illustrative embodiment, the electronic gaming device may include a computer, in which the logic component includes a central processing unit (CPU) 122 and a memory 124 that stores the gaming operations and processes of the interactive game. A fast memory cache 126 may also be employed by the CPU 122 to more efficiently access data or software stored in the memory 124. It shall be appreciated by those skilled in the art that the memory cache is a memory that is resident on the CPU 122. Additionally, it shall be appreciated by those skilled in the art that the logic component does not have to be a CPU and may include a plurality of logic gates and switches that are either programmed, e.g. a field programmable gate array, or may be an application specific integrated circuit (ASIC).

In the illustrative gaming device embodiment, the processor 122 is configured to perform the single reel game operations. Additionally, the gaming device typically includes a network interface card that is communicatively coupled to a network so the gaming device is configured to communicate with the network as presented below in FIG. 1G.

Additionally, in the illustrative embodiment a player interface 128 is operatively coupled to the CPU 122. By way of example and not of limitation, the player interface 128 may include a touch screen video display 102 and a handle 104. Alternatively, the player interface 128 may also include a video display (not shown) having a plurality of switches (not shown) that permit the player to interact with the stand alone device 100. Another alternative player interface 128 is a computer monitor (not shown) having a keyboard or mouse (not shown). Preferably, the player interface includes a monetary input component as described above. Thus, the player interface 128 includes any interface that permits the player to interact with the stand alone system and input desired gaming parameters.

In an illustrative embodiment, a random number generator 130 is a software module used in the selection of at least one game selected symbol from a set of game symbols during a game event. The game event is defined as a period during which the at least one game selected symbol is picked from the set of game symbols. A game session is comprised of a plurality of game events. The set of game symbols includes numbers, letters, geometric figures, animated figures, or any combination thereof. In the illustrative embodiment, the random selection of a game selected symbol involves generating a random number and using the random number as a basis for picking at least one game selected symbol from within the set of game symbols. It shall be appreciated by those skilled in the art that the random number generator is typically a software program that is stored in the memory 124 and processed by CPU 122.

Alternatively, the picking of at least one game selected symbol from the set of game symbols may be simulated using systems and methods that provide the appearance of a random selection. By way of example and not of limitation, the appearance of random selection can be created using well known "lottery" based systems and methods.

In another embodiment, the stand alone gaming device 100 may include a network interface card (NIC) 132 that permits the stand alone device 100 to communicate with a plurality of other devices configured to play the interactive game. The NIC 132 may also use well known networking protocols to communicate with other networked devices. These well known protocols include Ethernet type protocol, TCP/IP protocols, or other such network protocols. Additionally, the stand alone devices maybe networked to provide access to a progressive jackpot. The progressive jackpot is a shared jackpot generated from the network of game devices.

Figure 1G:
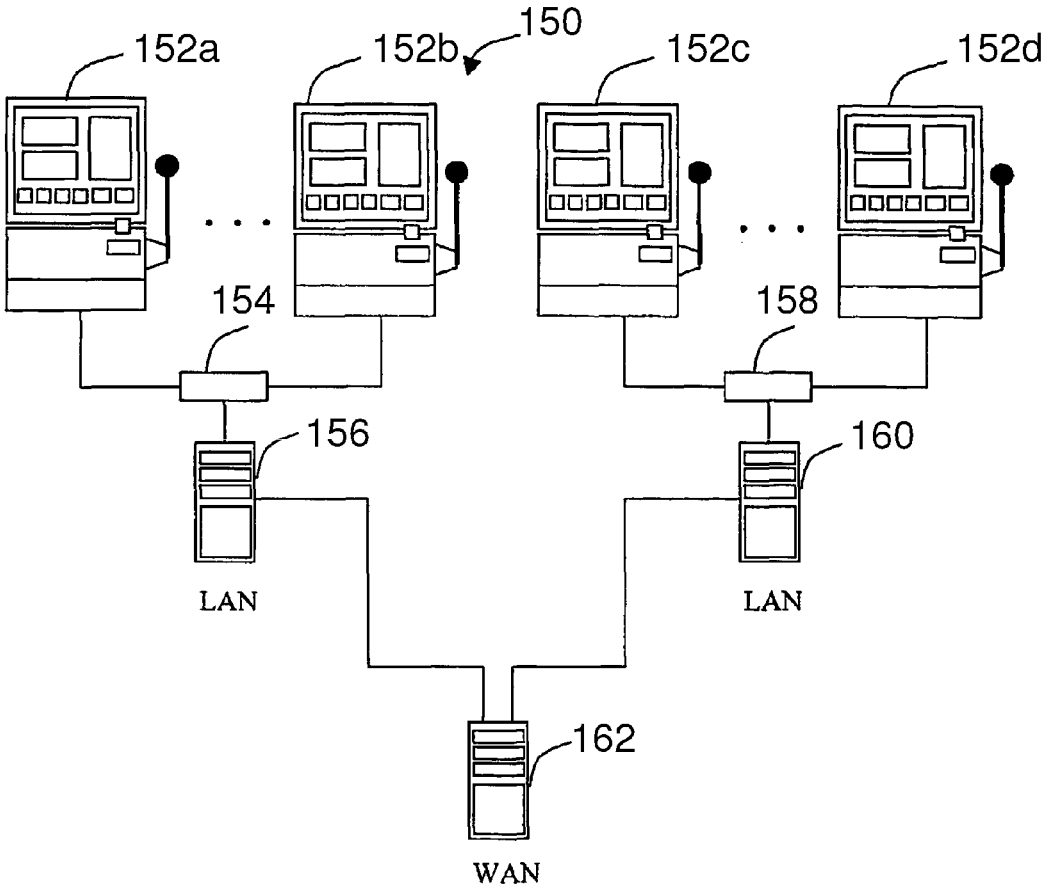
FIG. 1G shows an illustrative network system having a plurality of networked gaming devices.

Referring now to FIG. 1G, there is shown an illustrative network system 150 having a plurality of networked devices 152*a* through 152*d*. In one illustrative embodiment, the networked devices 152*a* through 152*d* are similar to the stand alone device 100. In the illustrative network system 150, the networked devices 152*a* and 152*b* are operatively coupled to a node 154 that communicates with a local area network (LAN) server 156. Additionally, the networked devices 152*c* and 152*d* are operatively coupled to a node 158 that is communication with a LAN server 160. The nodes 154 and 158 may be a hub, router, bridge, gateway. or any combination thereof that allows communications between the networked devices. It shall be appreciated by those skilled in the art that each LAN may operate independently of the other.

A wide area network (WAN) is created by linking the LANs together. For illustrative purposes only, both LANs communicate with a WAN server 162. For purposes of this patent, it can be appreciated that the distinction between a LAN and WAN is primarily geographic in nature. The LAN is geographically limited to a bank of illustrative stand alone gaming devices that may be resident on the casino floor. A WAN permits banks of networked devices from different casino locations to be networked. A primary purpose for networking the gaming devices is to generate a progressive jackpot. Additional reasons for networking include accounting, diagnostics, player tracking, and loyalty programs.

An alternative embodiment to the illustrative network system 150 comprises having the game logic for the interactive game resident on a central server. The central server may be either the LAN server 156 or WAN server 162. During game play, the server communicates game outputs to the appropriate client, i.e. one of the networked devices 152*a* through 152*d*. In yet another illustrative embodiment, the central server picks the game selected symbols and submits the game selected symbols to each of the clients on the network.

The gaming system includes a gaming server and a gaming client. More particularly, the gaming server includes a single reel module configured to generate and deliver a single reel that includes a plurality of symbols that are adjacent to one another. The gaming server also includes a track that displays the symbols in a spatial order, a starting reel stop that provides a reference point for stopping the single reel when the single reel is in motion, a win window that displays a plurality of the single reel symbols that fall within the win window, a payline that is overlaid on the symbols within the win window, and a paytable that lists a plurality of payout prizes for each combination of symbols along the payline. The gaming client includes a game session input that is communicated to the gaming server that stops the single reel at the starting reel stop according to the random game output module, and a display that presents a single reel game outcome. In the single reel gaming system, a prize is awarded when the single reel game symbols along the payline match the paytable combination of symbols.

Figure 1H:
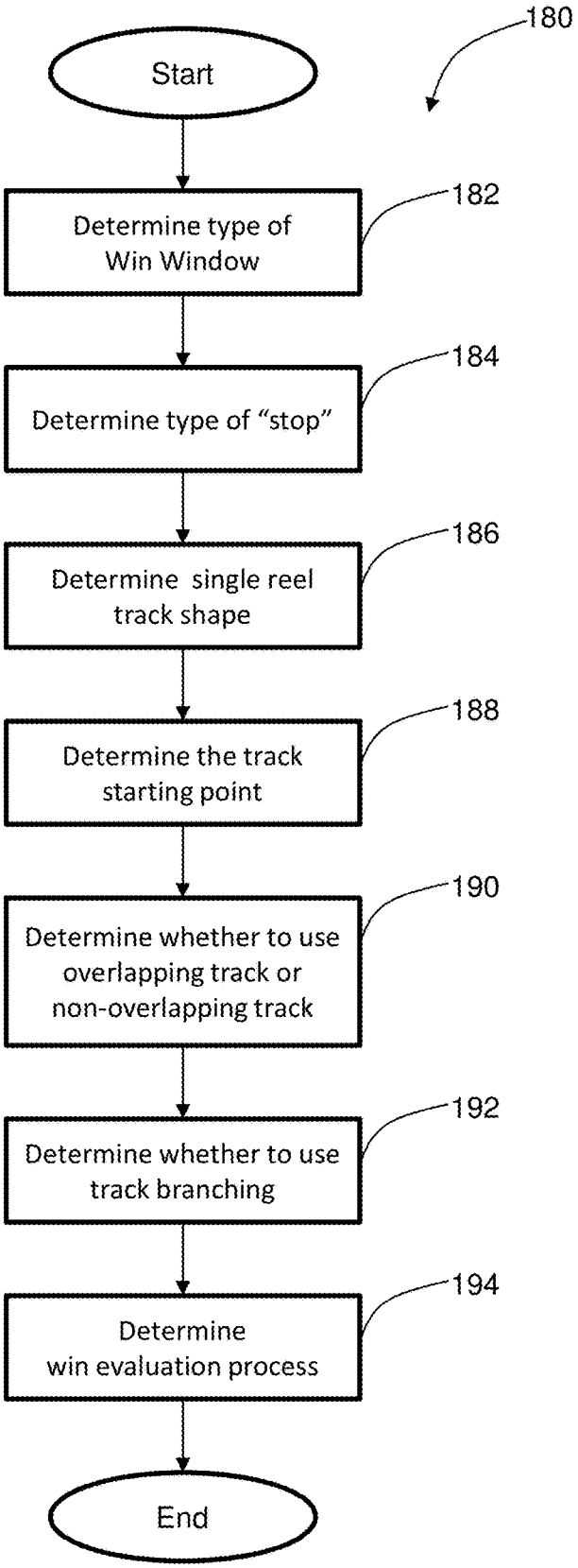
FIG. 1H shows a method for implementing the illustrative single reel game.

Referring now to FIG. 1H, there is shown a method for implementing the single reel game. The method is initiated at block 182 by determining the type of win window. By way of example and not of limitation, the win window may be a quadrilateral win window, an irregular win window, or a combination thereof.

Generally, the win window layout is expressed by established parameters such as the number of rows and columns for a win window that has a quadrilateral shaped, such as a square or rectangle. For example, the quadrilateral win windows or "regular" win windows may have a different set of rows and columns such as 3×3 (rows×columns), 3×4, 3×5, 4×4, 4×5, 4×6, 4×7, 5×5, 5×6, 5×7, 5×8, or any other quadrilateral reel layout.

Additionally, a win window may include irregular reel layouts that are defined based on column heights from left to right. By way of example and not of limitation, the irregular reel layouts for a win window may include: 3 unit column height on the far left, an adjacent 4 unit column height, a 5 unit column height adjacent to the previous 4 unit column, a 4 unit column adjacent to the 5 unit column, and a 3 unit column adjacent to the 4 unit column. A shorthand expression for the previous example references the column height from left to right, so the previous illustrative embodiment may be referred to as a 3,4,5,4,3 irregular win window. Other illustrative irregular win windows include, but are not limited to, a 4,5,5,5,4 irregular win window; a 2,3,4,3,2 irregular win window; a 4,5,4,6,3 irregular win window; a 3,4,4,4,3 irregular win window; or any other such irregular reel layout.

There are a variety of methods that can be used to populate the win windows that are presented in further detail in FIG. 2 through FIG. 38. These variables may be applied individually or in combination and include the type of stop, the single reel track shape, the track starting point, the use of an overlapping track or non-overlapping track, use of track branching and the win evaluation process.

In block 184, a determination is made of the type of "stop" that includes either a consecutive reel stop or a non-consecutive reel stop population. A consecutive reel stop refers to all of the positions in the win window being populated by consecutive stops from the single reel game. Thus in a consecutive reel stop, all the symbol positions or symbols in the win window are populated by consecutive stops from the single reel game.

A non-consecutive reel stop population refers to the possibility that there may be one (1) or more reel stops in the single reel population that are positioned just outside of the win window. The result is that the positions in the win window are populated by stops from the UNIREEL™ that are not fully consecutive. The non-consecutive stop allows for a "tease" situation where players might see a helpful symbol just outside of the win window showing them that they there were close to having a special symbol in their particular win window outcome.

In block 186 the single reel game method then proceeds to determine the type of single reel track shape. The illustrative track shapes presented herein include a horizontal snake track shape, a vertical snake track shape, a spiral track shape, and an irregular track shape. The illustrative horizontal snake track shape alternates between moving from left-to-right and right-to-left and moves either up or down when the end of each column is reached. The illustrative vertical snake track shape alternates between moving from top-to-bottom and bottom-to-top and moves either right or left when the end of each column is reached. The illustrative spiral track shape starts either on the outer-most or inner-most positions in the win window and spirals inward or outward respectively to cover all of the win window positions. The illustrative irregular track shape includes having a track cross any or all of the positions in any win window.

In block 188 the method proceeds to determine the track starting point. The track starting point is the point on the win window where the track begins. By way of example and not of limitation, the track starting point may include one of an upper right-hand corner, an upper left-hand corner, a lower right-hand corner, a lower left-hand corner, or any position in any win window.

In block 190, a determination is made of whether to use an overlapping track or a non-overlapping track. An illustrative overlapping track occurs when the single reel track overlaps itself in at least one reel stop. A non-overlapping track occurs when the line that the single reel track does not overlap itself.

At block 192, a determination of whether to use track branching is made. Certain single reel embodiments presented herein may include track branching that allows the single reel track to fracture along track branch points or locations, so that some of the symbols from the original track continue on one of the branched tracks, and some of the symbols continue along another branched track. Thus in track branching, the track branches into two or more branched tracks. Of course, some single reel embodiments may not include track branching.

At block 194, a determination of the win evaluation process is performed. In one illustrative embodiment, the win evaluation process may be based on the number of "lines" being evaluated for awarding a prize. For example, the line evaluation may be based on 30 paylines or 40 paylines based on the amount wagered or the amount of lines selected by the player. Another illustrative win evaluation embodiment relies on a "ways" evaluation, in which a particular number of designated symbols in each column are multiplied by the column totals for the designated columns; this embodiment may also be referred to as an "assisted" win. Other win evaluation processes shall readily suggest themselves to those of ordinary skill in the art having the benefit of this disclosure.

The single reel game may also be combined with other features to diversify the potential wager outcomes. Since the illustrative single reel game includes a win window that is populated by a single reel, the number outcomes are limited by the length of the single reel. Thus, the game play experience may benefit from combining the single reel with one or more primary game features or game events that supply multiple outcome variations. These primary game "feature" symbols may be triggered by a particular game event, in which one or more symbols on the UNIREEL™ "land" in the win window; for example, the feature symbol may operate as "wild card" type symbols that changes based on the other symbols along a particular payline. Additionally, the primary game may also include other feature symbols that may be triggered by unrelated or random game events that may occur on the electronic gaming machine, another electronic gaming machine, or an operation on a server communicatively coupled to the gaming device that is running the single reel game. Furthermore, the feature symbols may have the effect of transforming certain designated symbols that were populated in the win window so that a particular feature symbol may have represent two or more symbols. Further still the feature symbol may transform any symbol that lands on one or more designated win window locations into another symbol that could result in awarding the player a prize.

FIG. 2 through FIG. 38 present various win windows, types of stops, types of single red track shape, various track starting points, overlapping or non-overlapping tracks, and various uses of track branching and win evaluation.

Figure 2:
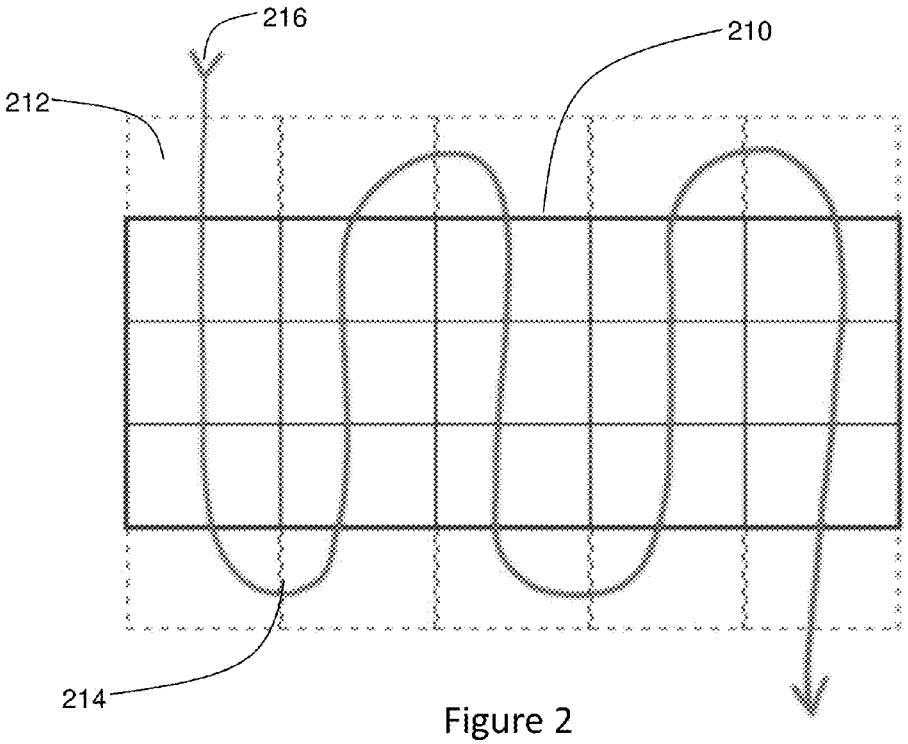
FIG. 2 shows a 3×5 win window with a vertical non-consecutive reel stop population.

For example, in FIG. 2 there is shown a 3×5 window with a vertical non-consecutive reel population. More specifically, the 3×5 win window payout 210 includes the non-consecutive reel stop population 212, a vertical snake track shape 214 and an upper left track starting point 216. The illustrative embodiment does not include an overlapping track and there is no track branching.

Figure 3:
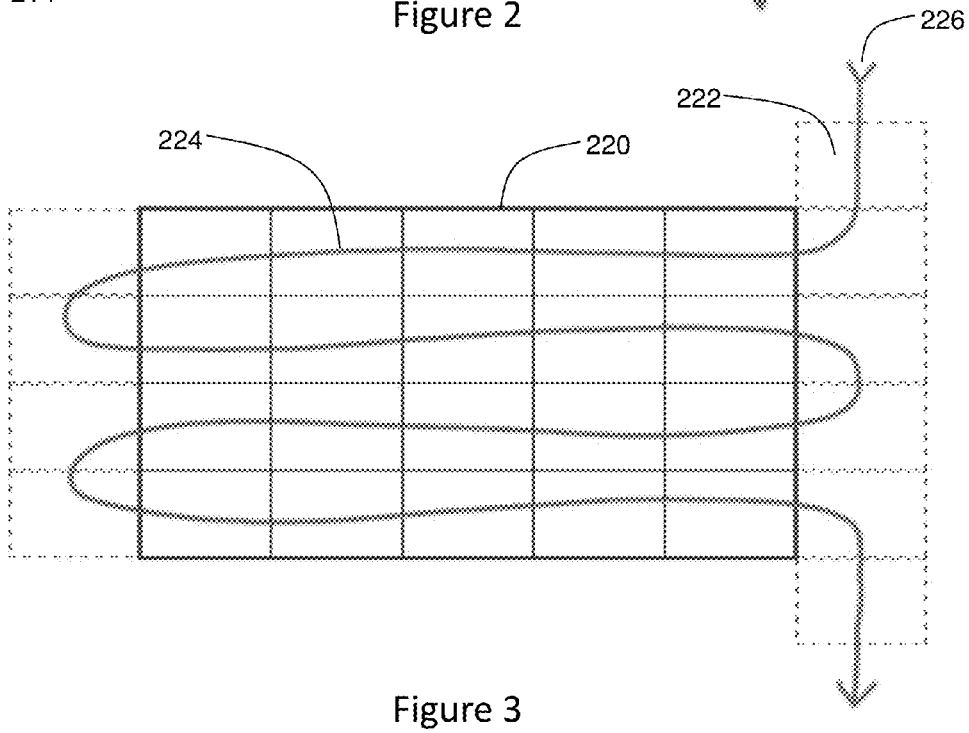
FIG. 3 shows a 4×5 win window with a horizontal non-consecutive reel stop population.

Referring now to FIG. 3, there is shown a 4×5 window with a horizontal non-consecutive reel population. The 4×5 win window layout 220 includes the non-consecutive reel stop population 222, a horizontal snake track shape 224 and an upper right track starting point 226. The illustrative embodiment does not include an overlapping track and there is no track branching.

Figure 4:
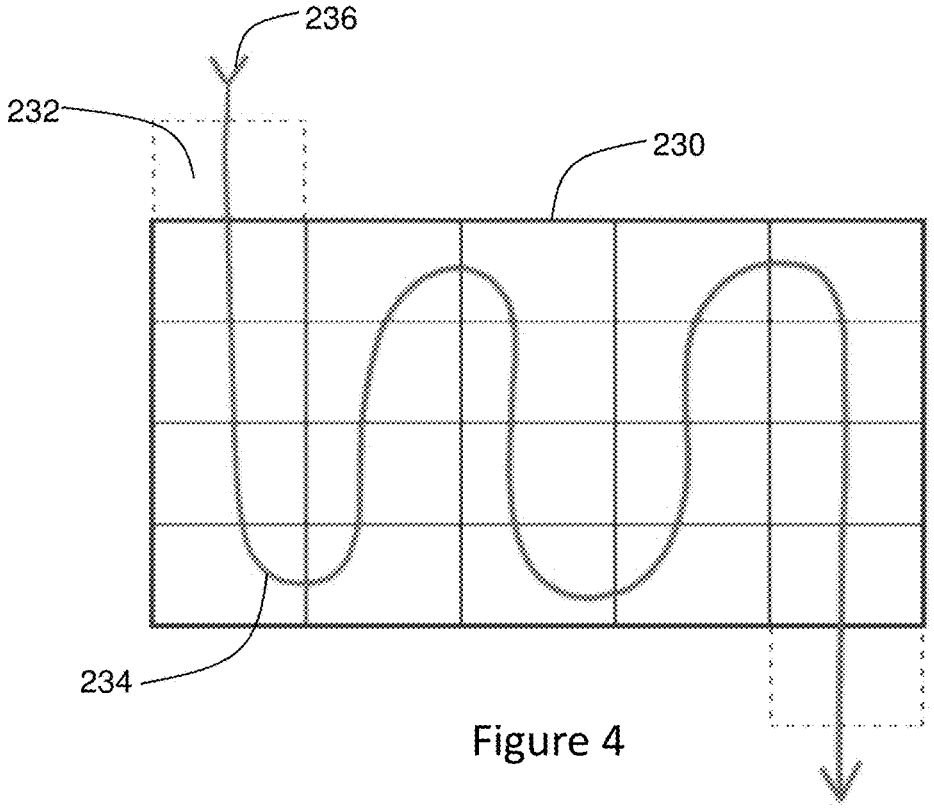
FIG. 4 shows a 4×5 win window with a vertical consecutive reel stop.

In FIG. 4 there is shown a single reel embodiment with a 4×5 win window and a vertical consecutive reel stop. In addition, the 4×5 win window layout 230 includes a consecutive reel stop 232, a vertical snake track shape 234, and an upper left track starting point 236. The illustrative embodiment does not include an overlapping track and there is no track branching.

Figure 5:
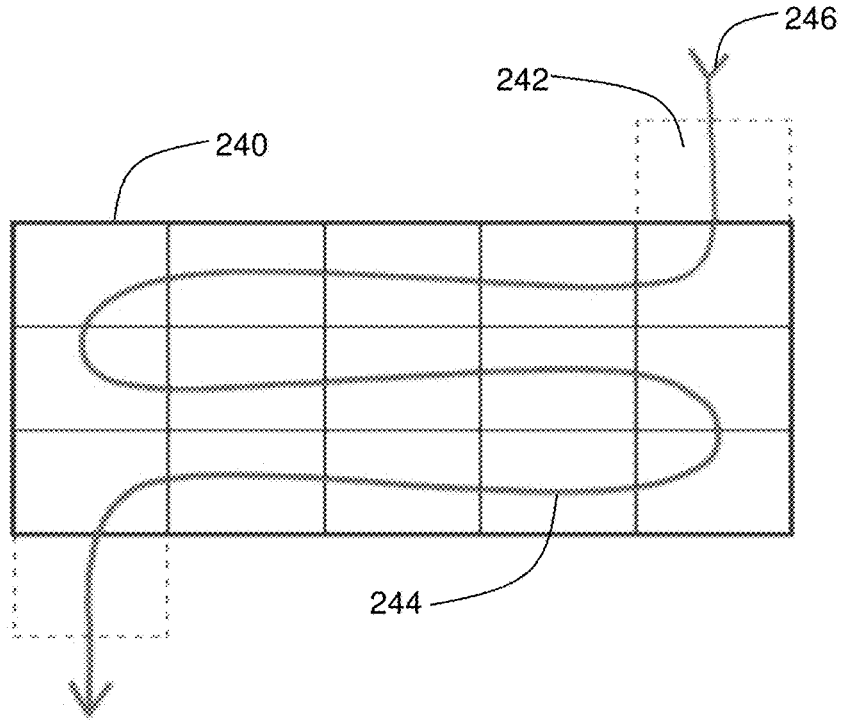
FIG. 5 shows a 3×5 win window with a horizontal consecutive reel stop.

Referring now to FIG. 5 there is shown a single reel embodiment with a 3×5 win window with a horizontal consecutive reel stop. The single reel embodiment includes a 3×5 win window layout 240, a consecutive reel stop 242, a horizontal snake track shape 244, an upper right track starting point 246, no overlapping track and no track branching.

Figure 6:
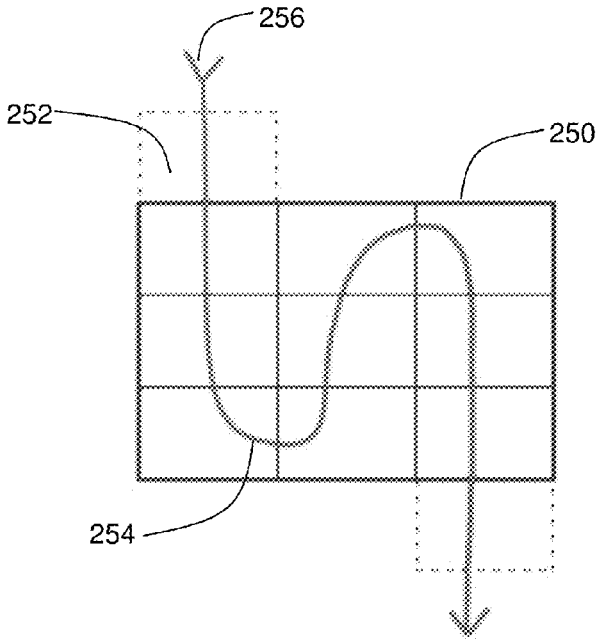
FIG. 6 shows a 3×3 win window with a vertical consecutive reel stop.

Referring to FIG. 6, there is shown a 3×3 win window with a vertical consecutive reel stop. More specifically, the single reel game embodiment includes a 3×3 win window layout 250 with a consecutive reel stop 252, a vertical snake track shape 254, an upper left track starting point 256, no overlapping track and no track branching.

Figure 7:
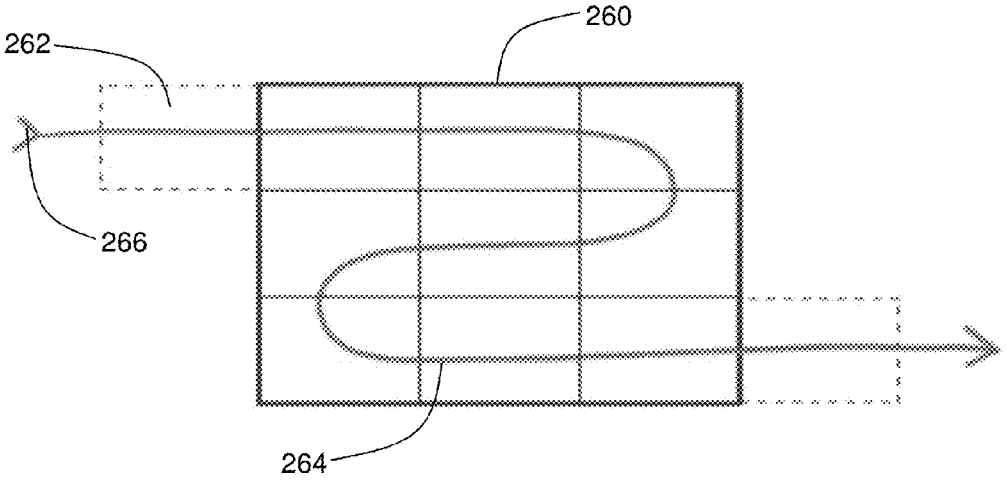
FIG. 7 shows a 3×3 win window with a horizontal consecutive reel stop.

Referring now to FIG. 7, there is shown a 3×3 win window with horizontal consecutive reel stop. This illustrative single reel embodiment includes a 3×3 win window layout 260, a consecutive reel stop 262, horizontal snake track shape 264, an upper left track starting point 266, no overlapping track and no track branching.

Figure 8:
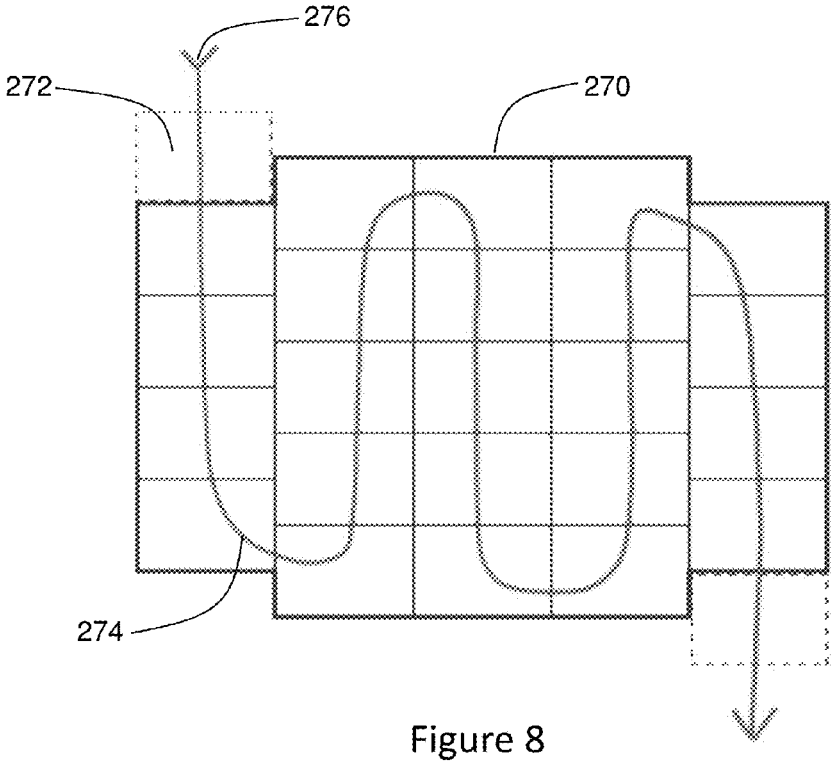
FIG. 8 shows a 4,5,5,5,4 win widow with a vertical consecutive reel stop.

Referring to FIG. 8, there is shown a 4,5,5,5,4 win widow with a vertical consecutive reel stop. More specifically, the illustrative single reel embodiment includes an irregular win window 270 with a displayed symbol layout of 4,5,5,5,4, a consecutive reel stop 272, a vertical snake track shape 274, an upper left track starting point 276, no overlapping track and no track branching.

Figure 9:
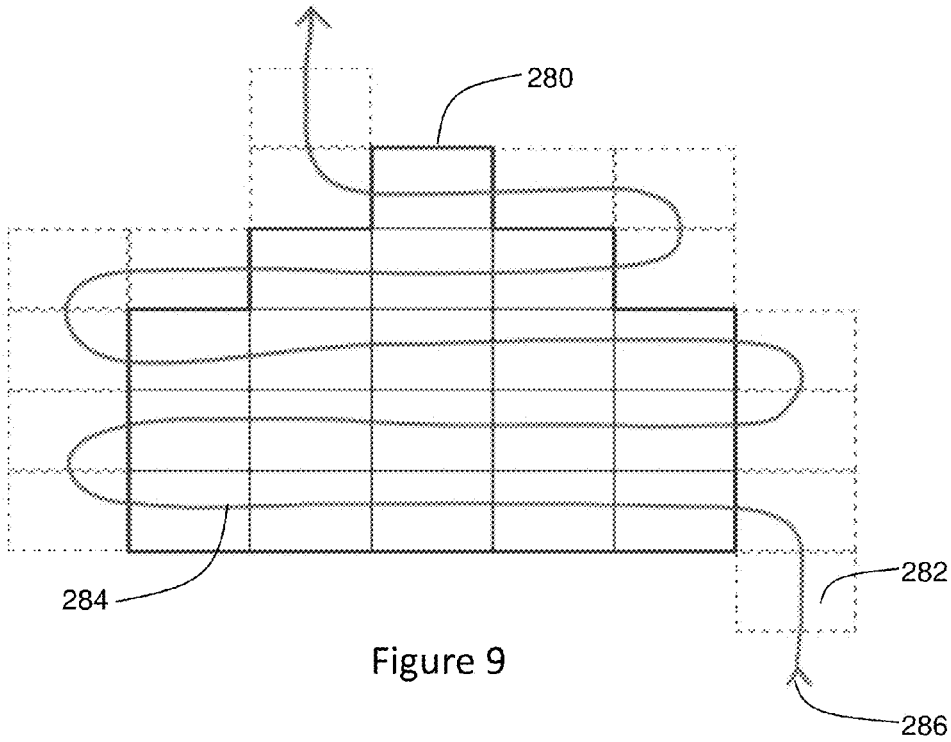
FIG. 9 shows a 3,4,5,4,3 win window with a non-consecutive reel population.

Referring to FIG. 9, there is shown a 3,4,5,4,3 win window with a non-consecutive reel population. In the illustrative single reel embodiment, there is shown an irregular win window 280 with a displayed symbol layout of 3,4,5,4,3 having a non-consecutive reel stop population 282, a horizontal snake track shape 284, a lower right track starting point 286, no overlapping track and no track branching.

Figure 10:
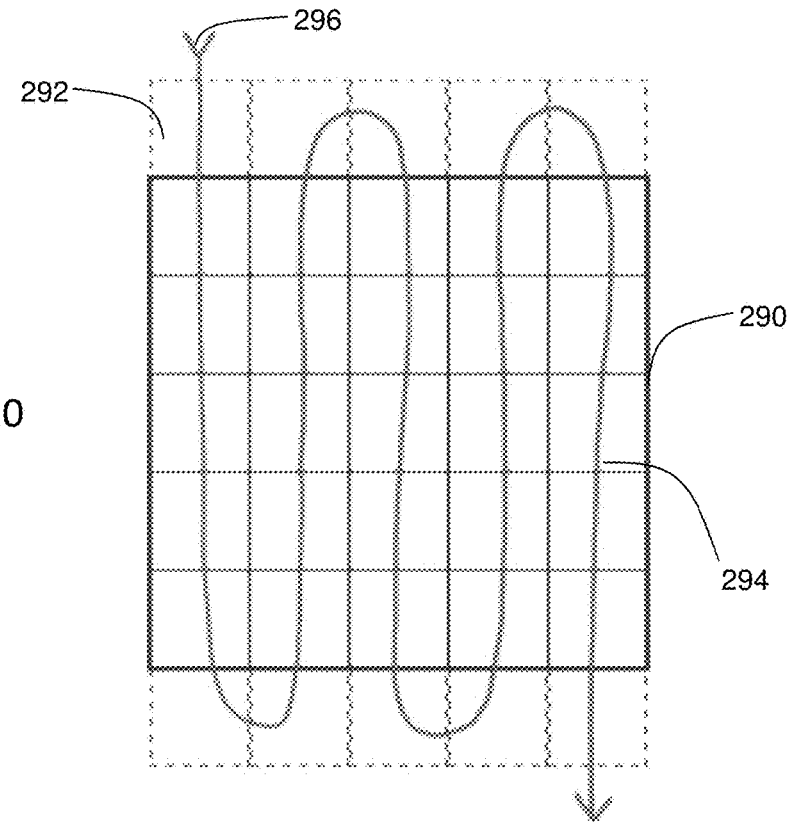
FIG. 10 shows a 5×5 win window with a vertical non-consecutive stop reel population.

Referring to FIG. 10, there is shown a 5×5 win window with a vertical non-consecutive reel stop population. The illustrative single reel embodiment includes a 5×5 win window layout 290, a vertical non-consecutive reel stop population 292, a vertical snake track shape 294, an upper left track starting point 296, no overlapping track and no track branching.

Figure 11:
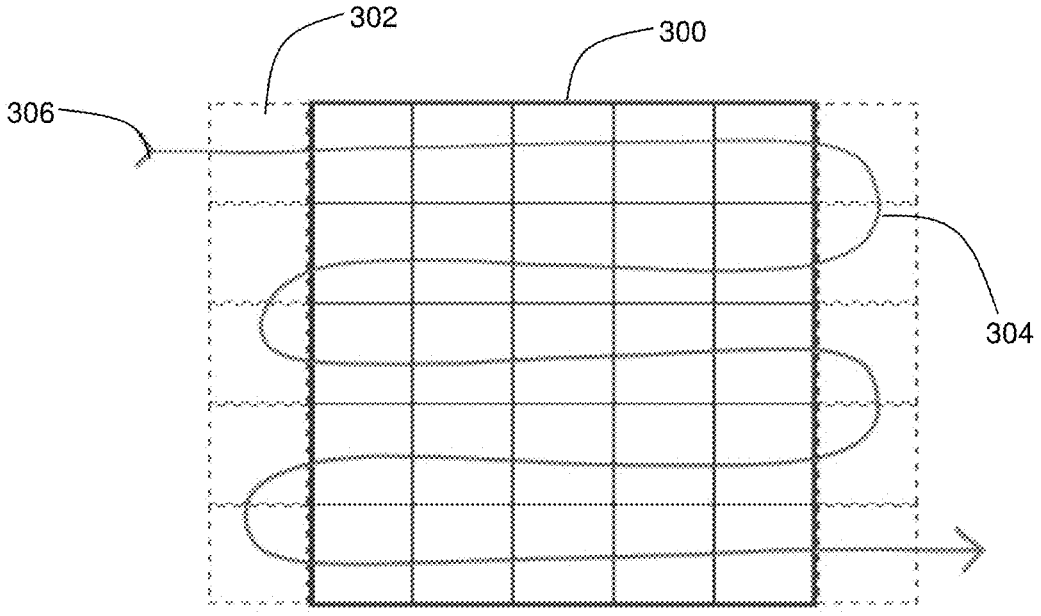
FIG. 11 shows a 5×5 win window with a horizontal non-consecutive reel stop population.

Referring now to the illustrative embodiment FIG. 11, which shows a 5×5 win window with horizontal non-consecutive reel stop population. The illustrative single reel embodiment includes the 5×5 win window layout 300, a non-consecutive reel stop population 302, a horizontal snake track shape 304, an upper left track starting point 306, no overlapping track, and no track branching.

Figure 12:
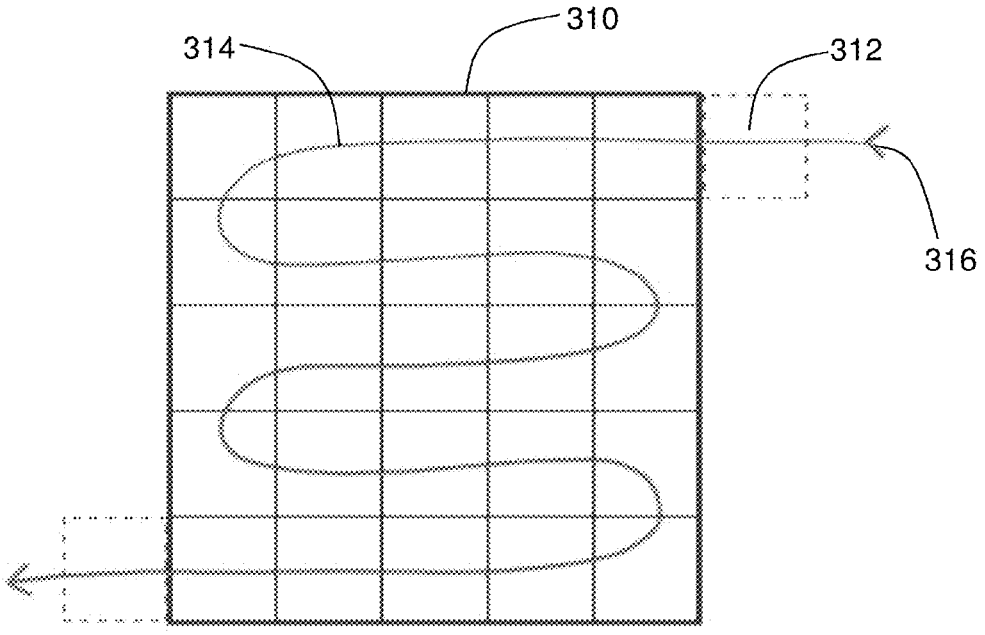
FIG. 12 shows a 5×5 win window with a horizontal consecutive reel stop.

Referring to FIG. 12, there is shown shows a 5×5 win window with a consecutive reel stop. More specifically, the illustrative single reel embodiment includes a 5×5 win window layout 310, a consecutive reel stop 312, a horizontal snake track shape 314, an upper right track starting point 316, no overlapping track and no track branching.

Figure 13:
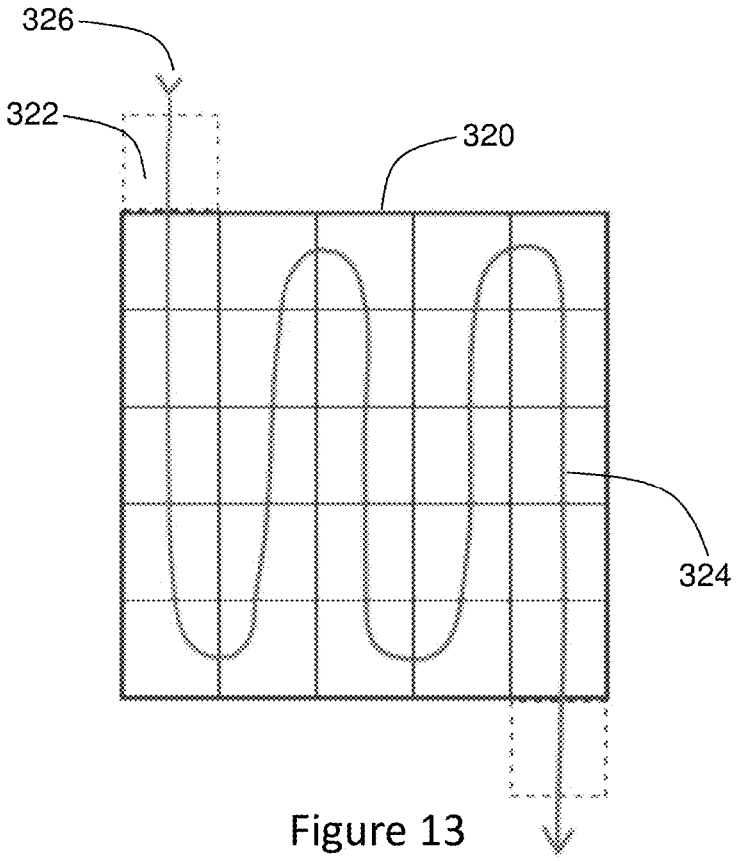
FIG. 13 shows a 5×5 win window with a vertical consecutive reel stop.

Referring to FIG. 13, there is shown a 5×5 win window with a consecutive reel stop. The illustrative single reel embodiment includes a 5×5 win window layout 320, with a consecutive reel stop 322, a vertical snake track shape 324, an upper left track starting point 326, no overlapping track and no track branching.

Figure 14:
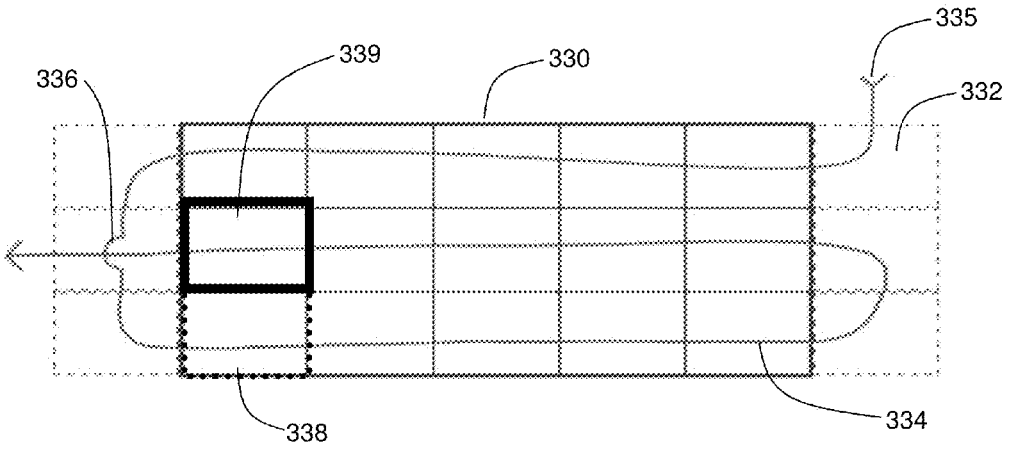
FIG. 14 shows a 3×5 win window with an overlapping vertical non-consecutive reel stop population.

Referring to FIG. 14, there is shown a 3×5 win window with an overlapping vertical non-consecutive reel population. The illustrative single reel embodiment includes a 3×5 win window layout 330 with non-consecutive reel stop population 332, a horizontal snake track shape 334, an upper right track starting point 335, an overlapping track 336, and no track branching. The overlapping track symbol 336 crosses paths with the snake track shape 334. The overlapping track symbol 336 is an earlier symbol to the symbol 338 and is within the 3×5 win window layout 330. Additionally, the overlapping track symbol 336 is also the symbol that follows the final track symbol 339 in the 3×5 win window layout 330.

Figure 15:
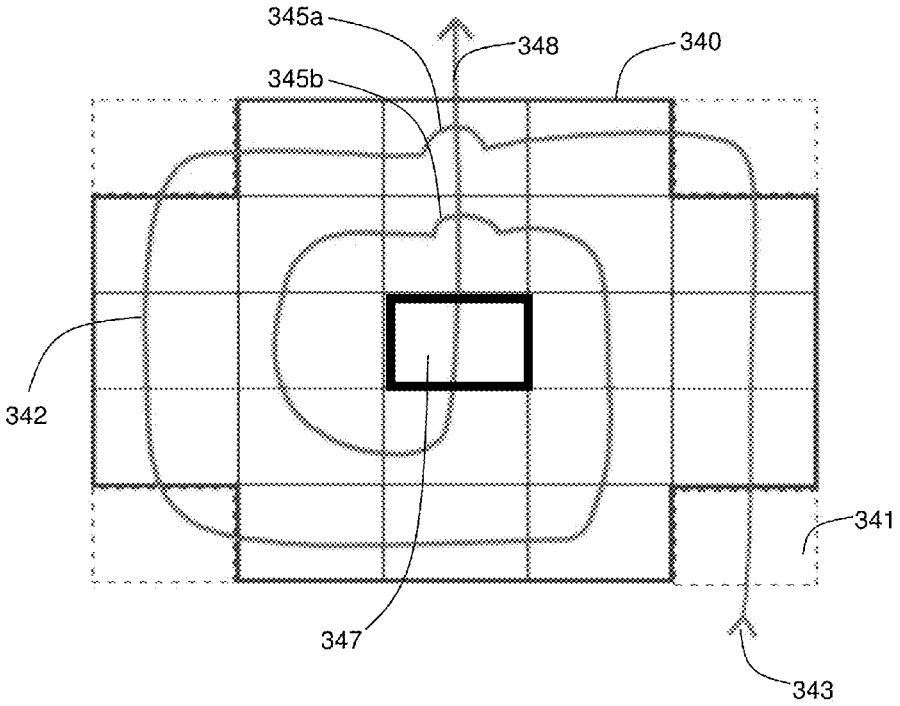
FIG. 15 shows a 3,5,5,5,3 win window with an overlapping non-consecutive circular reel stop population.

Referring now to FIG. 15, there is shown a 3,5,5,5,3 win window with an overlapping non-consecutive circular reel stop population. The illustrative single reel embodiment includes the irregular 3,5,5,5,3 win window layout 340, a non-consecutive reel stop population 341, an inward spiral track shape 342, a lower right track starting point 343, overlapping track symbols 345*a* and 345*b* and no track branching. In this illustrative embodiment, the symbols follow the track on the inward spiral until they reach the center 347. Once the symbols reach the center 347, the symbols follow the remaining track 348, which crosses paths with overlapping track symbols 345*a* and 345*b*, and eventually exit the win window 340.

Figure 16:
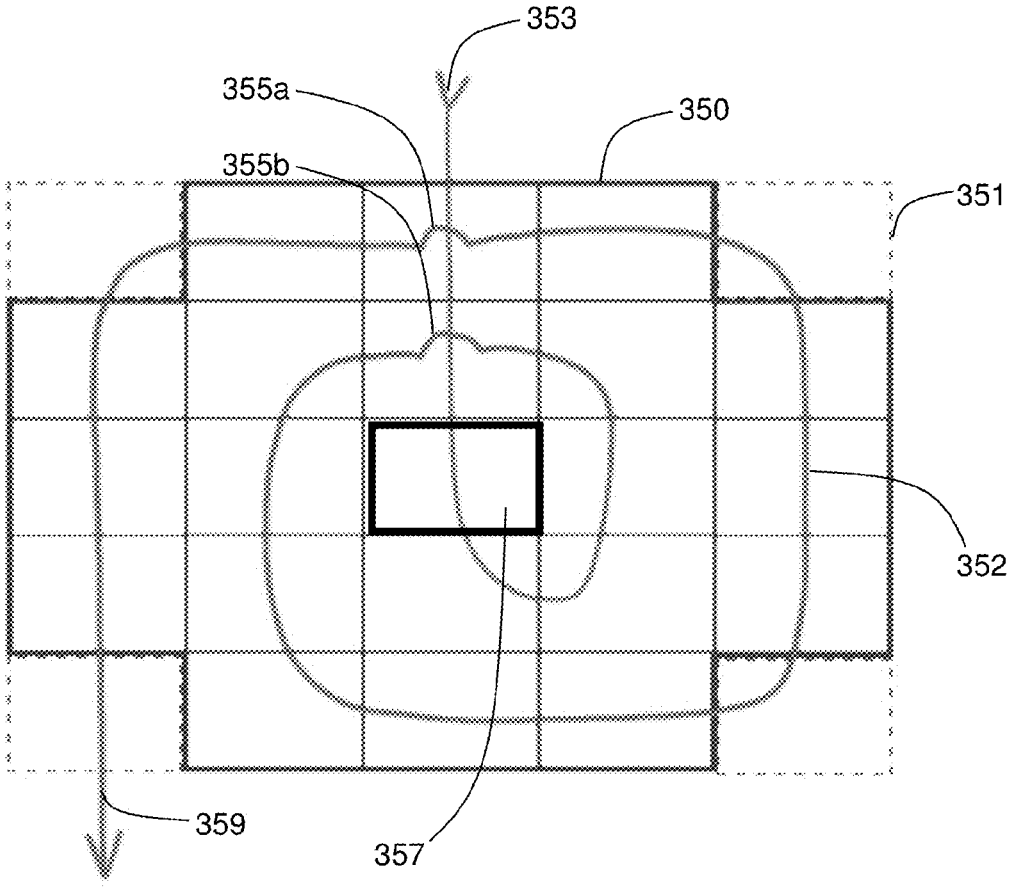
FIG. 16 shows a 3,5,5,5,3 win window with a variant overlapping non-consecutive circular reel stop population.

Referring to FIG. 16, there is shown a 3,5,5,5,3 win window with an overlapping non-consecutive circular reel stop population. The illustrative single reel embodiment includes an irregular 3,5,5,5,3 win window layout 350, a non-consecutive reel stop population 351, an outward spiral track shape 352, a top center position track starting point 353, overlapping track symbols 355*a* and 355*b* and no track branching. In this illustrative embodiment, the symbols travel in the reverse order as presented in FIG. 15. The overlapping tracking symbols 355*a* and 355*b* precede the center symbol 357. The remaining symbols along track 352 proceed along the track 352 in an outward spiral 359.

Figure 17:
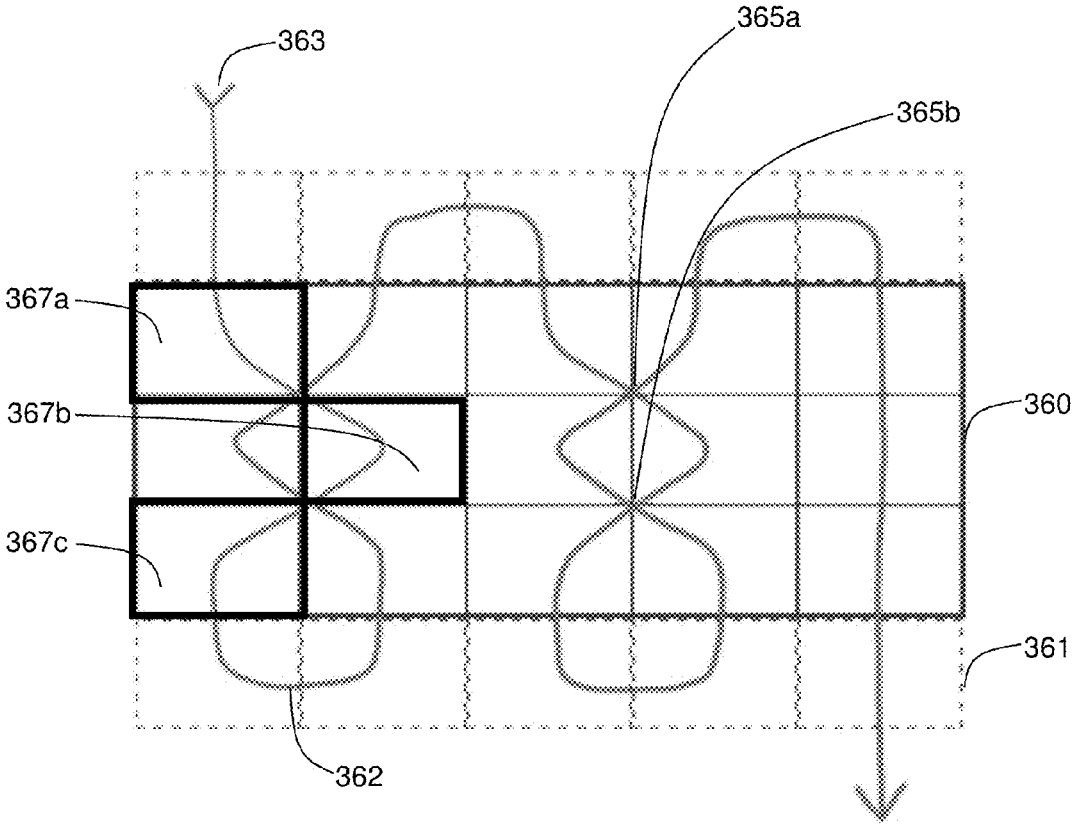
FIG. 17 shows a 3×5 win window with a multiple-overlapping vertical non-consecutive reel stop population.

Referring to FIG. 17, there is shown a 3×5 win window with a multiple-overlapping vertical non-consecutive reel stop population. The illustrative single reel game includes a 3×5 win window layout 360, a non-consecutive reel stop population 361, an irregular double crazy eight track shape 362, an upper left track starting point 363, overlapping track points 365*a* and 365*b*, and no track branching. In this illustrative embodiment, the symbols along track shape 362 cross paths and the symbols populate positions 367*a*, 367*b*, and 367*c* of the win window in an alternating order pattern which is different from the more regular consecutive ordering pattern described above.

Figure 18:
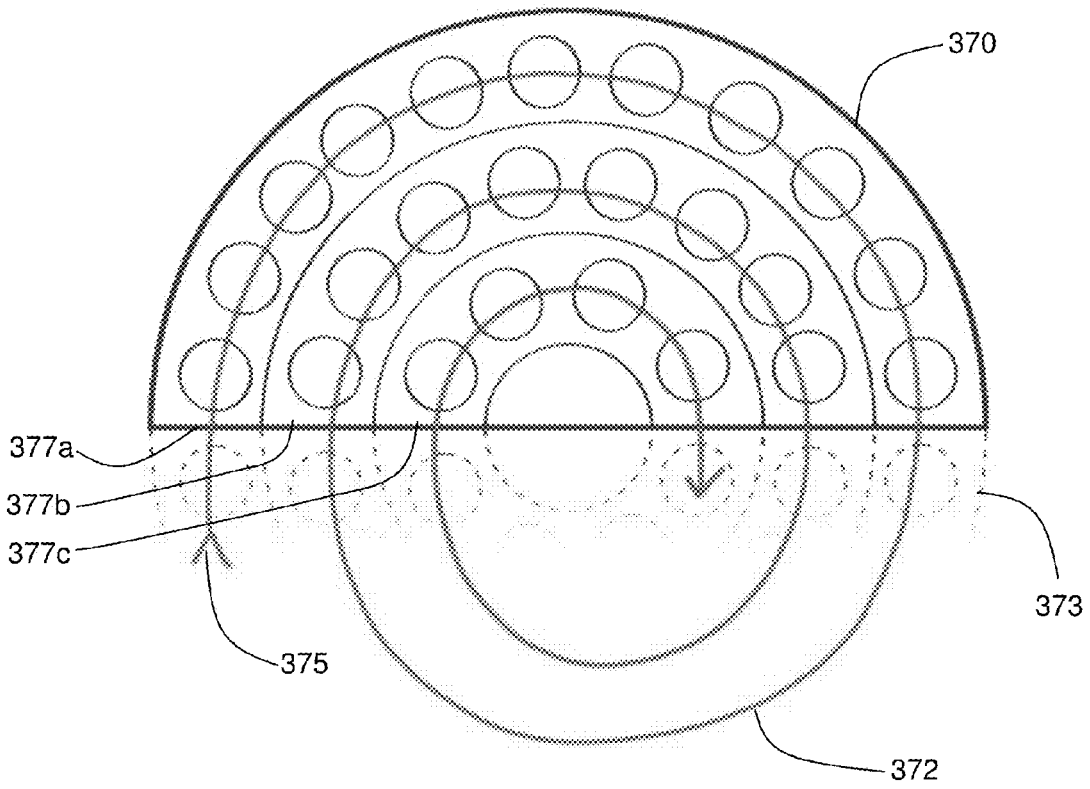
FIG. 18 shows a three ring semi-circle win window with a non-consecutive circular reel stop population.

Referring to FIG. 18, there is shown a three ring semi-circle win window with a non-consecutive circular reel stop population. The single reel embodiment includes irregular circular symbols and a semi-circular reel win window layout 370, a non-consecutive reel stop population 373, an inward spiral track shape 372, a lower left track starting point 375, no overlapping track and no track branching. In this illustrative embodiment, the win window is arranged in a series of concentric circles 377. In the illustrative embodiment, the win evaluation for a win window includes a custom line set, or may be calculated using the proximity of associated symbols.

Figure 19:
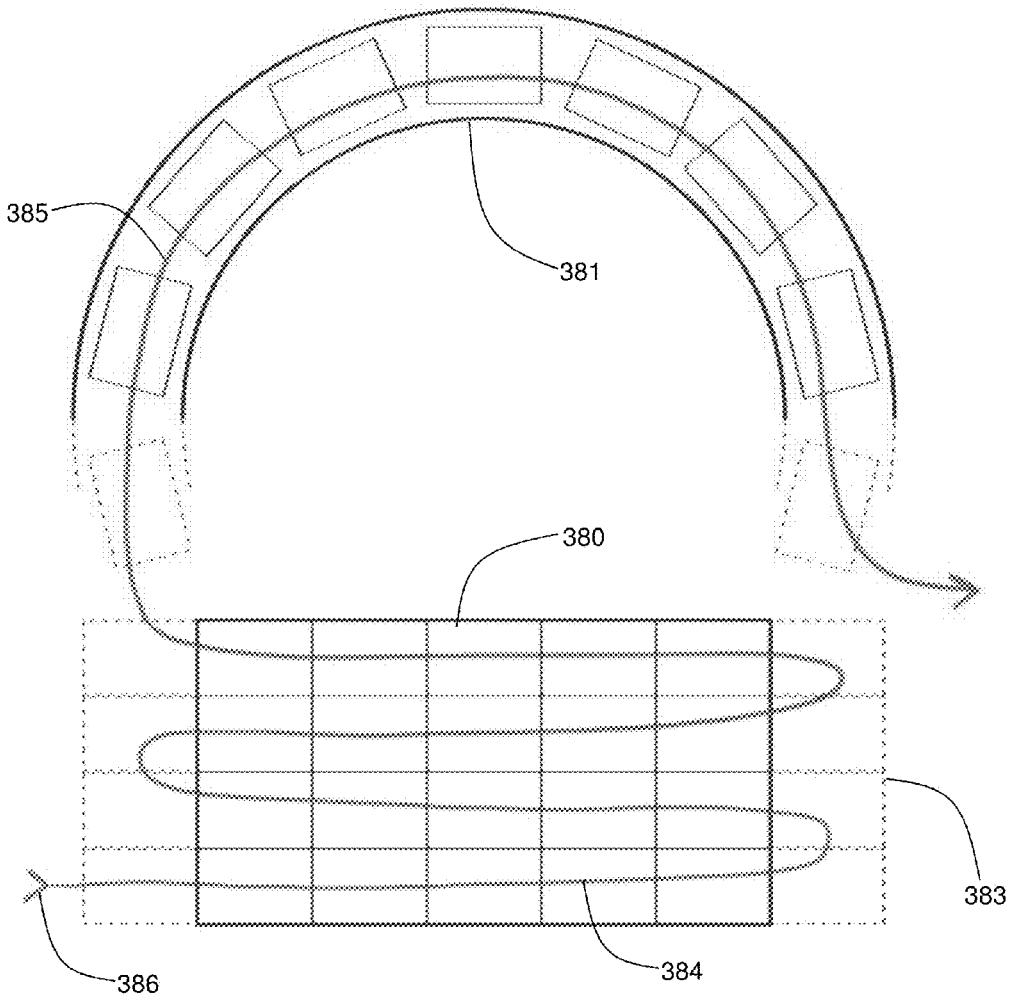
FIG. 19 shows a 4×5 win window with a semi-circular seven position bonus window.

Referring to FIG. 19, there is shown a 4×5 win window with a semi-circular seven-position bonus window that is populated horizontally. The illustrative single reel embodiment includes an irregular 4×5 win window layout 380, a top screen bonus wheel section window layout 381, a non-consecutive reel stop population 383, an irregular horizontal snake 384 with an extra top screen loop track shape 385, a lower left track starting point 386, no overlapping track, and no track branching. In this illustrative single reel embodiment, a standard win window interface is populated and the symbols then proceed along the track to another area of the win window. The additional win window area 381 is in a curved shape, as if it were along the edge of a spinning disk. This extra win window area 381 may be an extension of whatever win evaluation is occurring on the main portion of the win window 380, or it could be evaluated for wins using some custom method. By way of example and not of limitation, the symbols that land in the top win window area 381 are evaluated using a "hot line" or a special win line. The wins may be enhanced on the top win window are 381 with a win multiplier or a special symbol transformation feature affecting the symbols that land along the special win line. By way of example and not of limitation, symbols in the special curved section of the win window would be evaluated with every spin of the illustrative single reel game. In other illustrative examples, the symbols that land in the special curved section of the win window area 381 are evaluated for wins when a specified bonus event occurs. In yet another illustrative example, symbols are assigned credit equivalents and as the symbols move into the special curved section of the win window 381, the associated credit values are shown with the symbols (in front of, or above the symbols), and when the symbols land, one or more of the credit values associated with the symbols that landed in the special curved section of the win window could be awarded.

Figure 20:
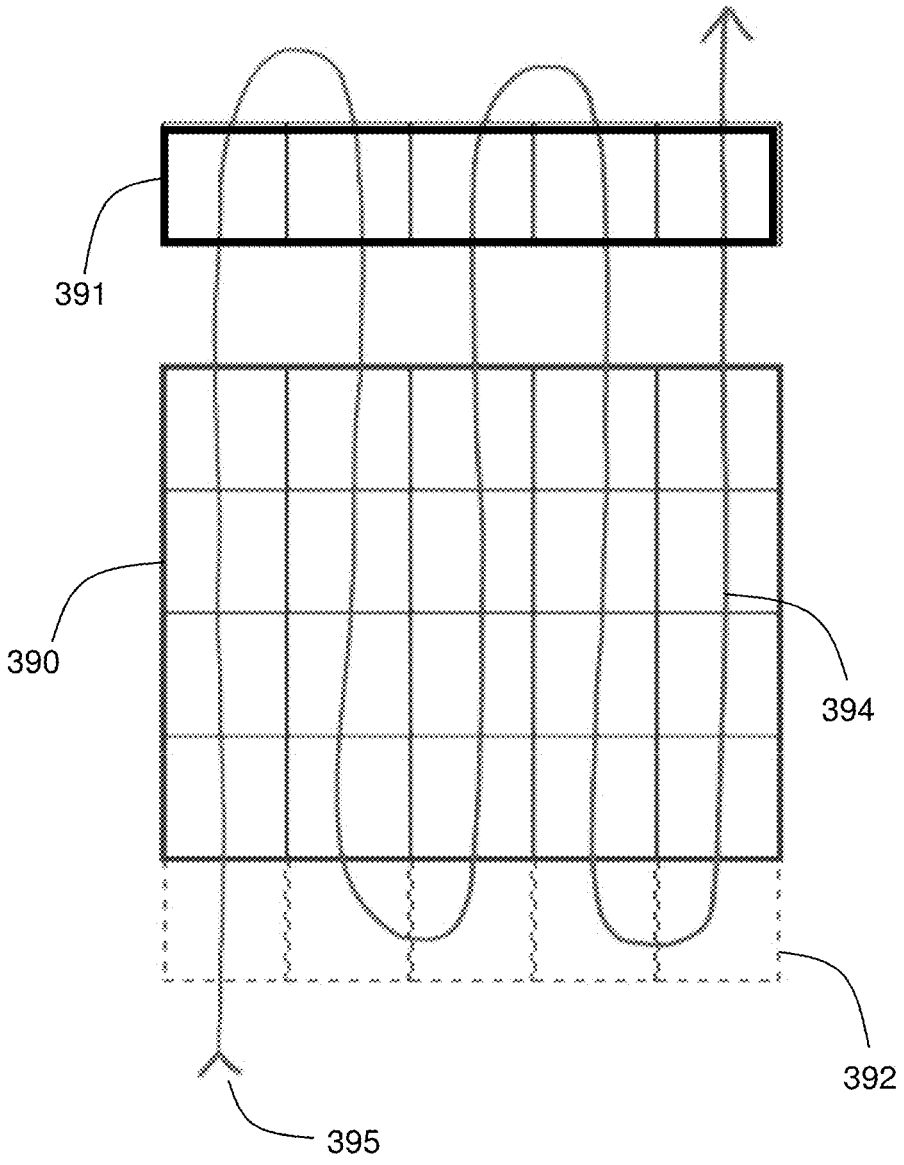
FIG. 20 shows a 4×5 win window with a five position bonus window.

Referring to FIG. 20, there is shown a 4×5 win window with a five-position bonus window that is populated vertically. The illustrative single reel embodiment includes an irregular 4×5 win window 390, a top screen bonus section window layout 391, non-consecutive reel stop population 392, an irregular vertical snake 394 with extra top screen row track shape, a lower left track starting point 395, no overlapping track and no track branching. FIG. 20 shows a standard win window area 390 and a special top win window area 391. The special top win window are 391 may be treated similarly to the special curved section of the win window 381 in FIG. 19.

Thus the extra win window area 391 may be an extension of whatever win evaluation is occurring on the main portion of the win window 390, or it could be evaluated for wins using some a "hot line" or a special win line, in which the wins may be enhanced on the top win window area 391 with a win multiplier or a special symbol transformation feature affecting the symbols that land along the special win line. The symbols in the top win window area may be evaluated with every spin of the illustrative single reel game. The symbols in the top win window area 391 may also evaluated for wins when a specified bonus event occurs. The symbols may also be assigned credit equivalents as they move into the special top section of the win window 391 so that one or more of the credit values associated with the symbols that landed in the special top section of the win window could be awarded.

Figure 21:
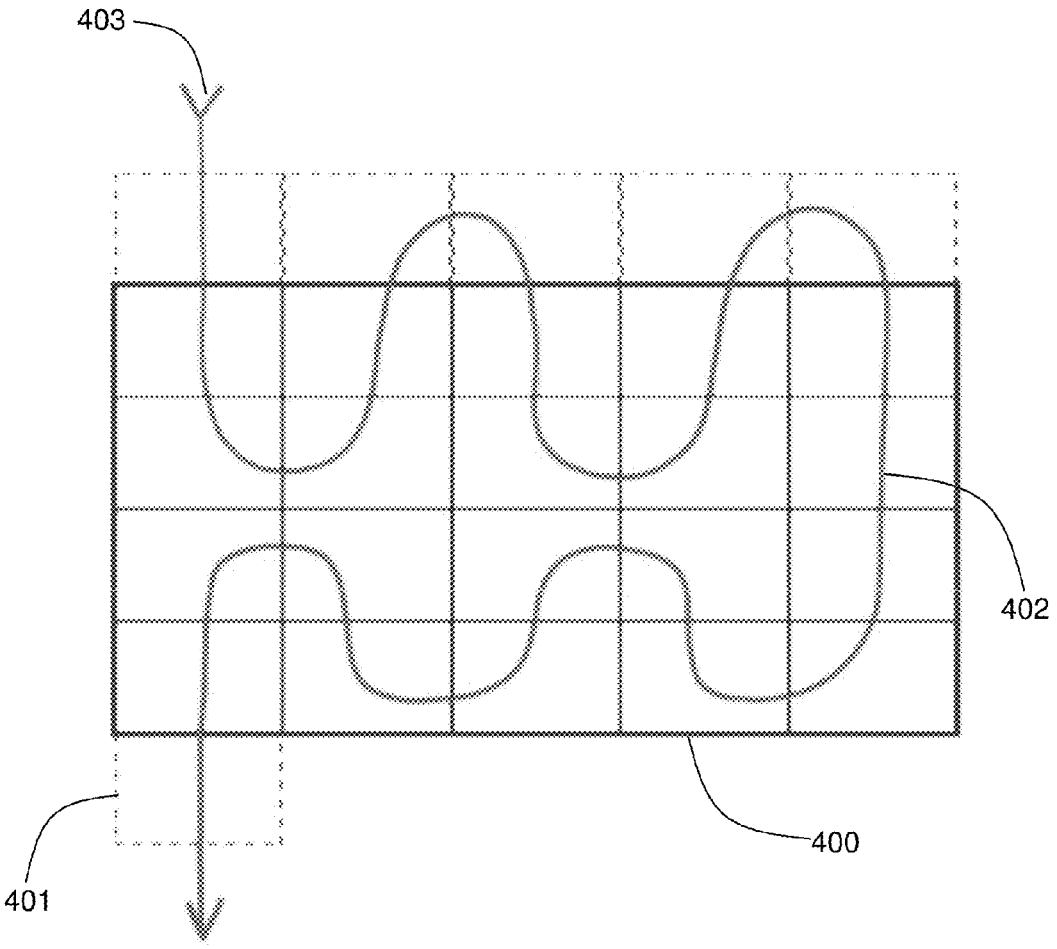
FIG. 21 shows a 4×5 win window with irregular pattern vertical non-consecutive reel stop population.

Referring to FIG. 21, there is shown a 4×5 win window with an irregular pattern vertical non-consecutive reel stop population. The illustrative single reel embodiment includes a 4×5 win window layout 400, a non-consecutive reel stop population 401, an irregular "rollercoaster" track shape 402, an upper left track starting point 403, no overlapping track and no track branching.

Figure 22:
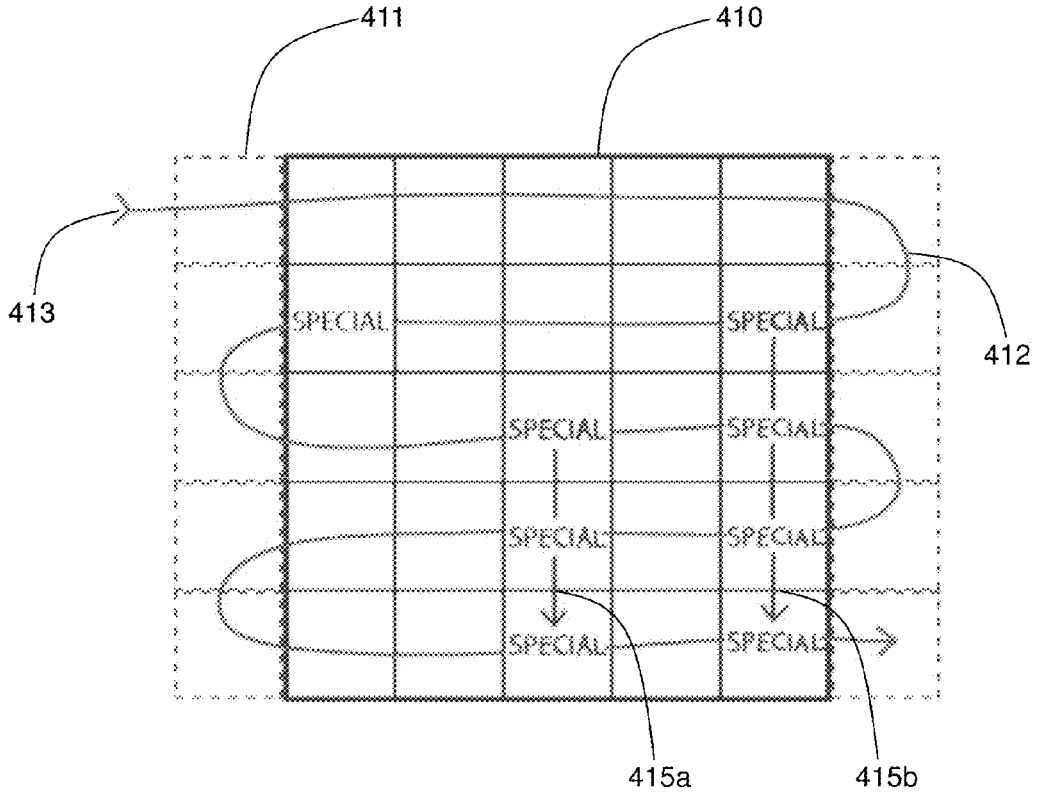
FIG. 22 shows a 5×5 win window with horizontal non-consecutive reel stop population with special symbols.

Referring to FIG. 22, there is shown a 5×5 win window with a horizontal non-consecutive reel stop population having special symbols. The illustrative single reel embodiment includes a 5×5 win window layout 410, a non-consecutive reel stop population 411, a horizontal snake track shape 412, an upper left track starting point 413, no overlapping track, a downwardly expanding wilds or "special" 415*a* and 415*b*, an expansion individually determined feature, and no track branching. In this illustrative embodiment, a symbol transformation feature provides multiple outcomes for the single reel game. In the illustrative embodiment, special symbols such as a "wild" or "special" symbol may perform a downward expansion if the wild or special symbols land in the win window. In this illustrative example, a random determination (that may be possibly weighted) is made for each individual special symbol that lands in the win window. Since each special symbol may perform this downward expansion or not, the number of possible outcomes related to any given single reel game is determined by this formula:

$$\text{NumberOfOutcomes}=2^{NumberSpecialSymbolsLandingInWinWindow}$$

Thus, the number of outcomes is equal to two to the power based on the "number of special symbols landing in the win window 410." In this illustrative embodiment, the number of additional associated outcomes can differ from stop to stop, because the number of special symbols landing in the win window can differ from stop to stop.

Figure 23:
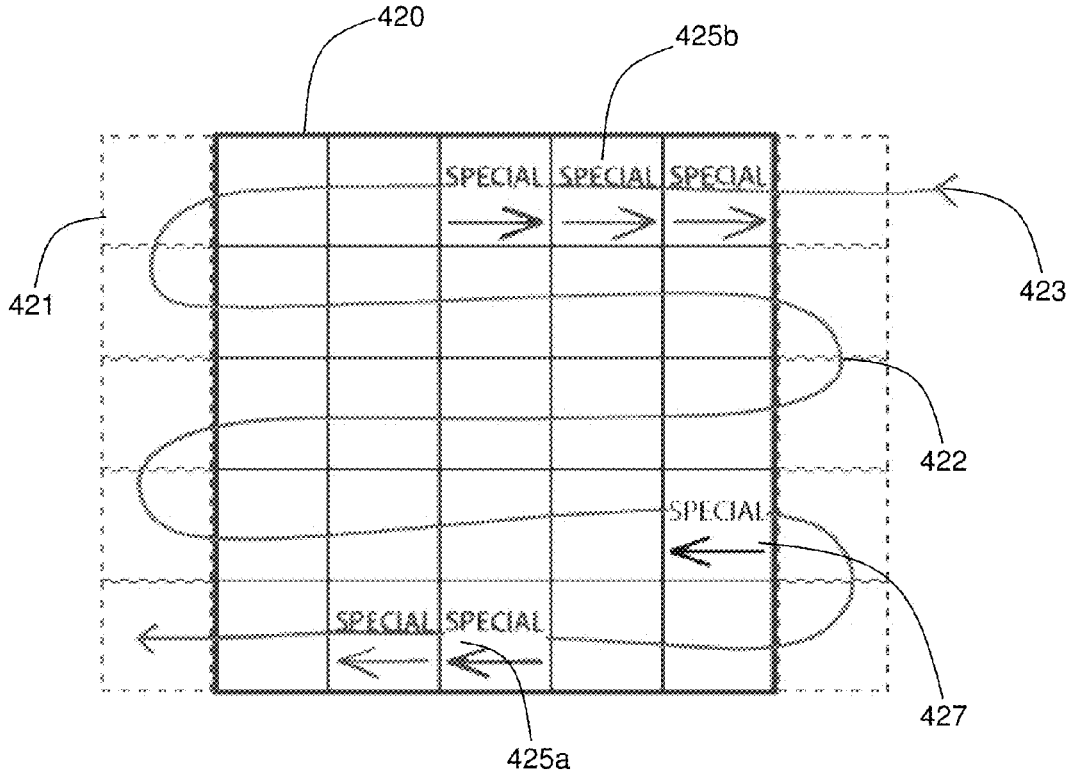
FIG. 23 shows a 5×5 win window with variant horizontal non-consecutive reel stop population with special symbols.

Referring to FIG. 23, there is shown a 5×5 win window with variant horizontal non-consecutive reel stop population with special symbols. The illustrative single reel embodiment includes a 5×5 win window layout 420, a non-consecutive reel stop population 421, a horizontal snake track shape 422, an upper right track starting point 423, no overlapping track, a directional expanding special or wild symbols 425*a* and 425*b*, and an expansion individually determined feature with no track branching. This illustrative embodiment is similar to FIG. 22 and incorporates by reference the description provided in FIG. 22. Additionally, in this illustrative example the base game or primary game feature shown is that of directional expansion so that the special or wild symbols have an arrow marking that represents the direction for the expansion. For example, a special symbol with an arrow pointing left 427 may expand left if activated; a special symbol with an arrow pointing right would expand right if activated. Much like the illustrative embodiment in FIG. 22, the determination of whether or not the special symbols activate the symbol expansion may be determined on an individual basis, which increases the number of possible outcomes associated with each single reel game stop.

Figure 24:
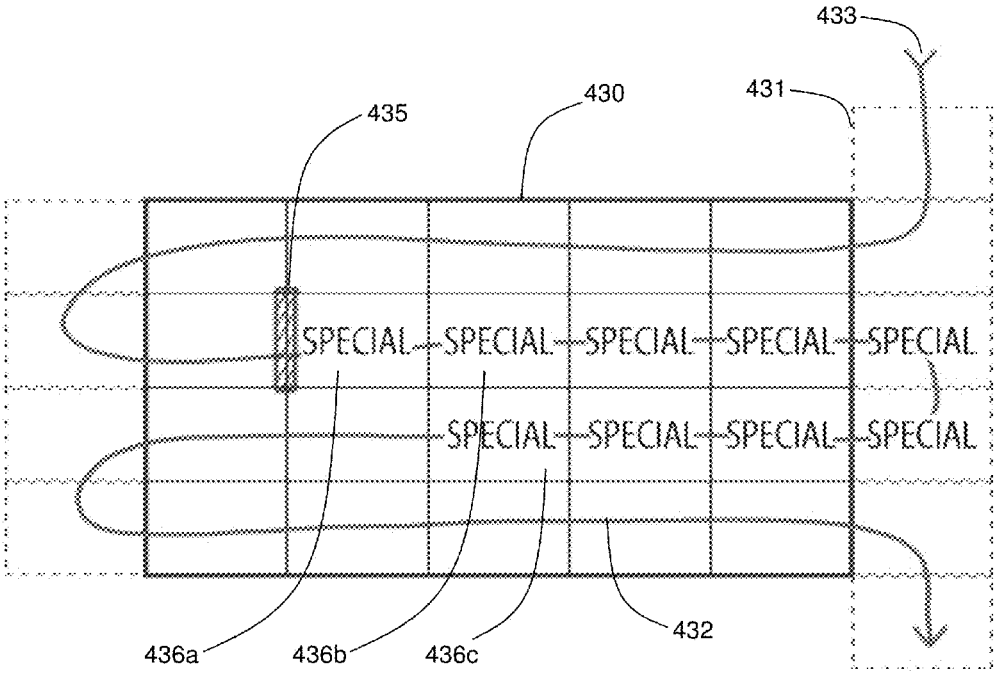
FIG. 24 shows a 4×5 win window with vertical non-consecutive reel stop population with a transformative gate.

Referring to FIG. 24, there is shown a 4×5 win window with a vertical non-consecutive reel stop population and a transformative gate. The illustrative single reel embodiment includes the 4×5 win window layout 430, a non-consecutive reel stop population 431, a horizontal snake track shape 432, an upper right track starting point 433, no overlapping track, a feature with a symbol conversion gate 435 having symbols passing through a gate, which are then transformed into special symbols 436, and no track branching. In this illustrative embodiment, a "special symbol conversion gate" 435 may be activated just before the single reel game has come to a complete stop. Once activated, the gate 435 may transform any symbol that passes through it into a special enhanced symbol. The gate 435 may be activated at different times in the reel spin cycle. In the illustrative embodiment, if the gate 435 has more time on a countdown timer and the gate is "open" before the reel stops, then more symbols will be converted by the gate as the unireel passes through the gate 435. If the gate is activated and there is less time on the countdown timer and the gate is open before the reel stops, then fewer symbols will be converted by the gate 435. These game events add more possible outcomes to each individual single reel game stop. The number of outcomes these game events provide for each individual single reel game stop may be determined by the following formula:

$$(\text{NumberOfOutcomes}=(\text{HighestNumberOfConvertedSymbols}-\text{LowestNumberOfConvertedSymbols})+1).$$

It should be noted that the "+1" in the formula above is due to the fact that the feature may or may not be activated.

Figure 25:
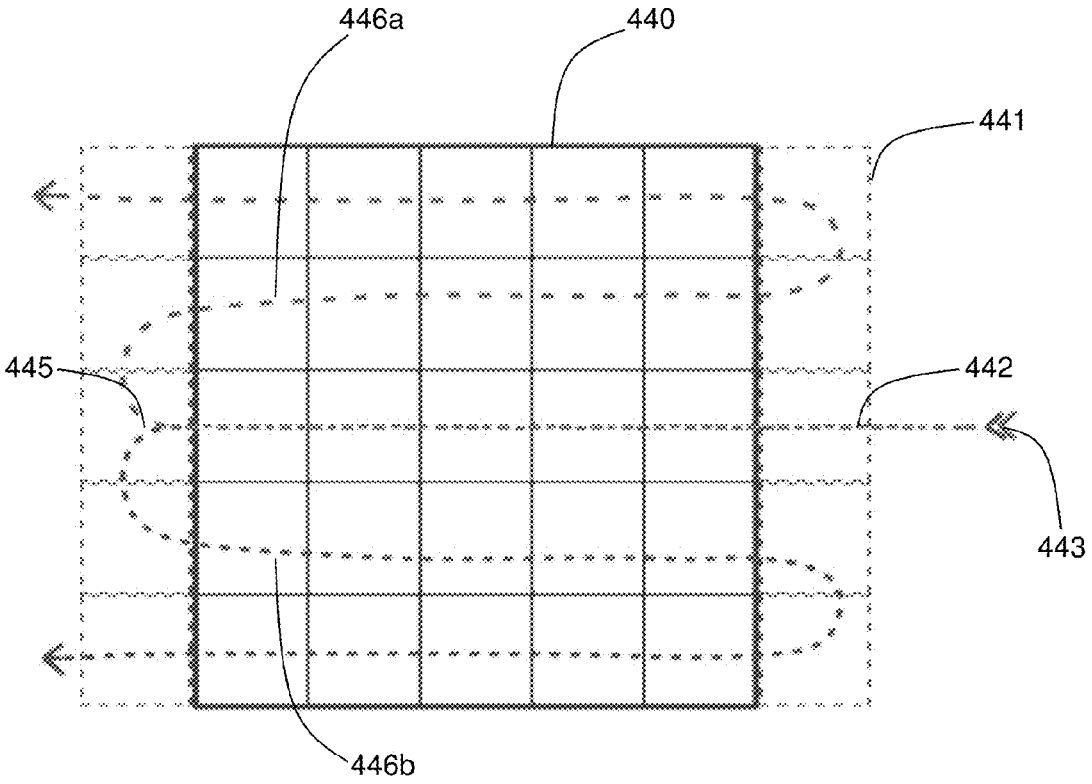
FIG. 25 shows 5×5 win window with horizontal non-consecutive branching track reel stop population.

Referring to FIG. 25, there is shown a 5×5 win window with a horizontal non-consecutive branching track reel stop population. The illustrative single reel embodiment includes a 5×5 win window layout 440, a non-consecutive reel stop population 441, an irregular horizontal snake with alternating zipper branching track shape 442, a center right track starting point 443, no overlapping track and track branching. In the illustrative alternating zipper branching embodiment, another method of populating a win window using a single reel having a plurality of symbols is shown.

In the illustrative alternating zipper branching embodiment, the single reel embodiment includes track branches, in which a single track 442 is split into two tracks at a split 445. As symbols move through the track branch, the symbols are distributed from the single track to the two branched tracks 446*a* and 446*b* in alternating fashion. In the illustrative embodiment, the symbols that move along the track after the track branches at split 445 move slower than those symbols that are at a point before the track branches. This motion differential is because the tracks emanating from the track branch point are only receiving half the number of symbols that the original track contains. In a scenario where multiple branches occur, this effect is compounded.

Figure 26:
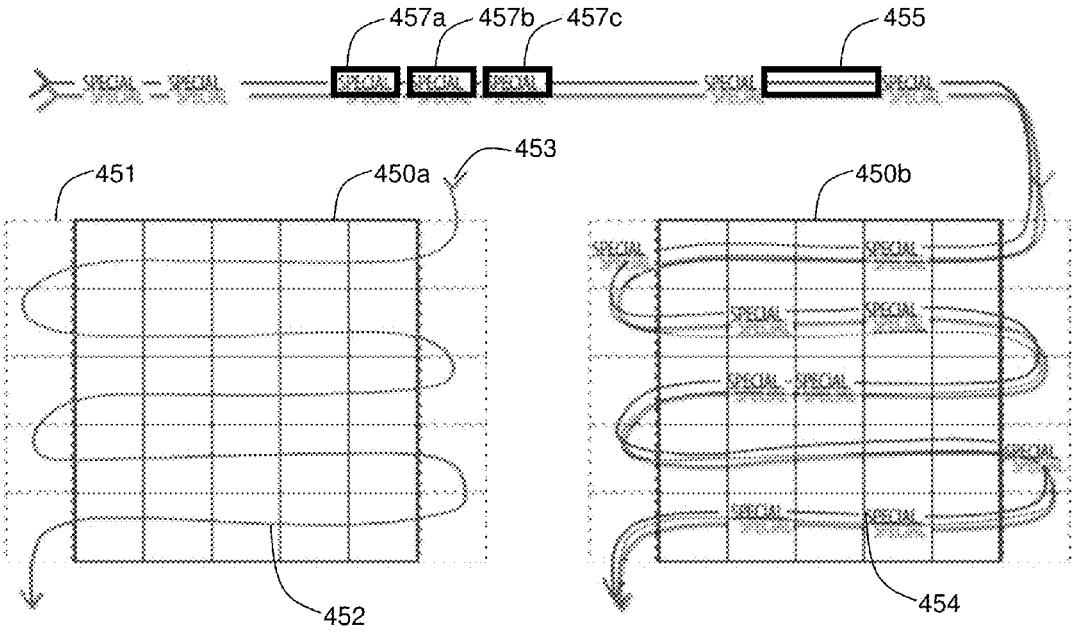
FIG. 26 shows a 5×5 win window with a horizontal non-consecutive reel stop population and a separate single reel 5×5 bonus window with special symbols and a horizontal non-consecutive reel stop population.

Referring to FIG. 26, there is shown a 5×5 win window having a horizontal non-consecutive reel stop population and a separate single reel 5×5 bonus window having special symbols and a horizontal non-consecutive reel stop population. The illustrative single reel primary game includes a 5×5 win window layout 450*a*, a non-consecutive reel stop population 451, a horizontal snake track shape 452, an upper right track starting point 453, and no overlapping track. The illustrative single reel bonus game includes a 5×5 win window layout 450*b* and a separate bonus reel 454. The second bonus reel 454 includes a plurality of illustrative win-enhancing symbols 457*a*, 457*b*, and 457*c* and no track branching. The illustrative bonus reel also includes illustrative blanks 455 that do not include win-enhancing symbols. In this illustrative embodiment, the primary game win window is populated with a single reel as opposed to the standard multiple-reel population shown in FIG. 27.

Figure 27:
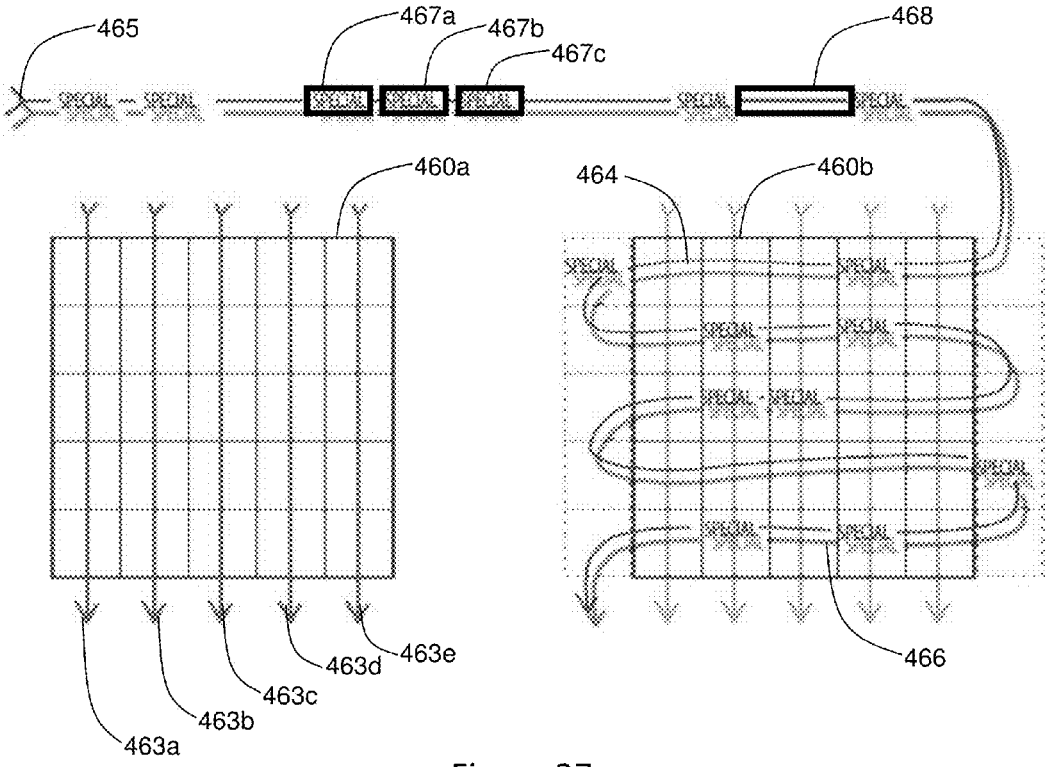
FIG. 27 shows a traditional 5×5 multi-reel slot window with a single reel 5×5 bonus window with special symbols and a horizontal non-consecutive reel stop population.

Referring to FIG. 27, there is shown a traditional 5×5 multi-reel slot window with a UNIREEL 5×5 bonus window having special symbols and a horizontal non-consecutive reel population. In the illustrative embodiment, the primary game includes a 5×5 win window layout 460*a*, a non-consecutive reel stop population, a track shape that is presented as a standard multi-reel game with reels 463*a*, 463*b*, 463*c*, 463*d*, 463*e*. The illustrative bonus game includes a secondary overlay population horizontal snake track shape 464, an upper right track starting point 465 with no overlapping track, a single reel bonus game 466 with win-enhancing symbols 467*a*, 467*b*, 467*c* and illustrative blanks 468, and no track branching. In this illustrative embodiment, the illustrative single reel game is deployed as a bonus or feature that enhances the symbols provided by an original spin of a standard multiple-reel population. If this illustrative bonus game or feature were activated, a single reel track would appear on front of the win window. By way of example and not of limitation, the single reel bonus game may contain a plurality of special enhancing symbols (such as wild symbols, multiplier symbols, etc. . . . ) and blanks. In operation, the illustrative single reel bonus game is configured to spin and stop. Once the single reel bonus game stops, the win enhancing symbols are configured to transform the original symbols from the win window.

Figure 28:
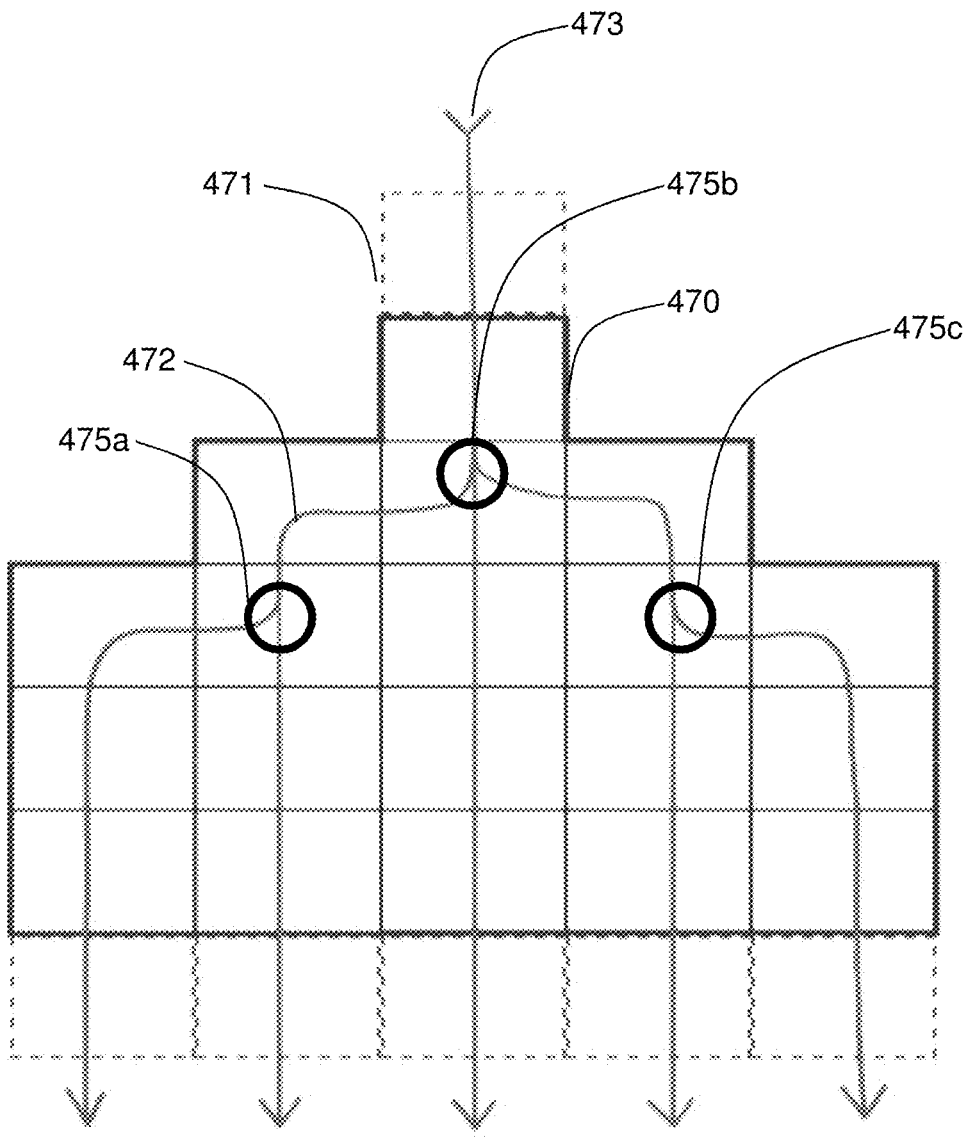
FIG. 28 shows a 3,4,5,4,3 win window with multiple branching and a vertical consecutive reel stop.

Referring to FIG. 28, there is shown a 3,4,5,4,3 win window with multiple branching and a vertical consecutive reel stop. More specifically, the illustrative single reel game includes an irregular 3,4,5,4,3 win window layout 470, a consecutive reel stop 471, an irregular track shape 472, a top center track starting point 473, no overlapping track and extensive track branching at branch locations 475*a*, 475*b* and 475*c*. In FIG. 28, the single reel is split into multiple branches at the branch location; the single reel is used to populate the irregularly shaped win window. In operation, the track branching slows the movement of single reel symbols because the symbols on the single reel are divided at the branch location 475*a*, 475*b* and 475*c*.

Figure 29:
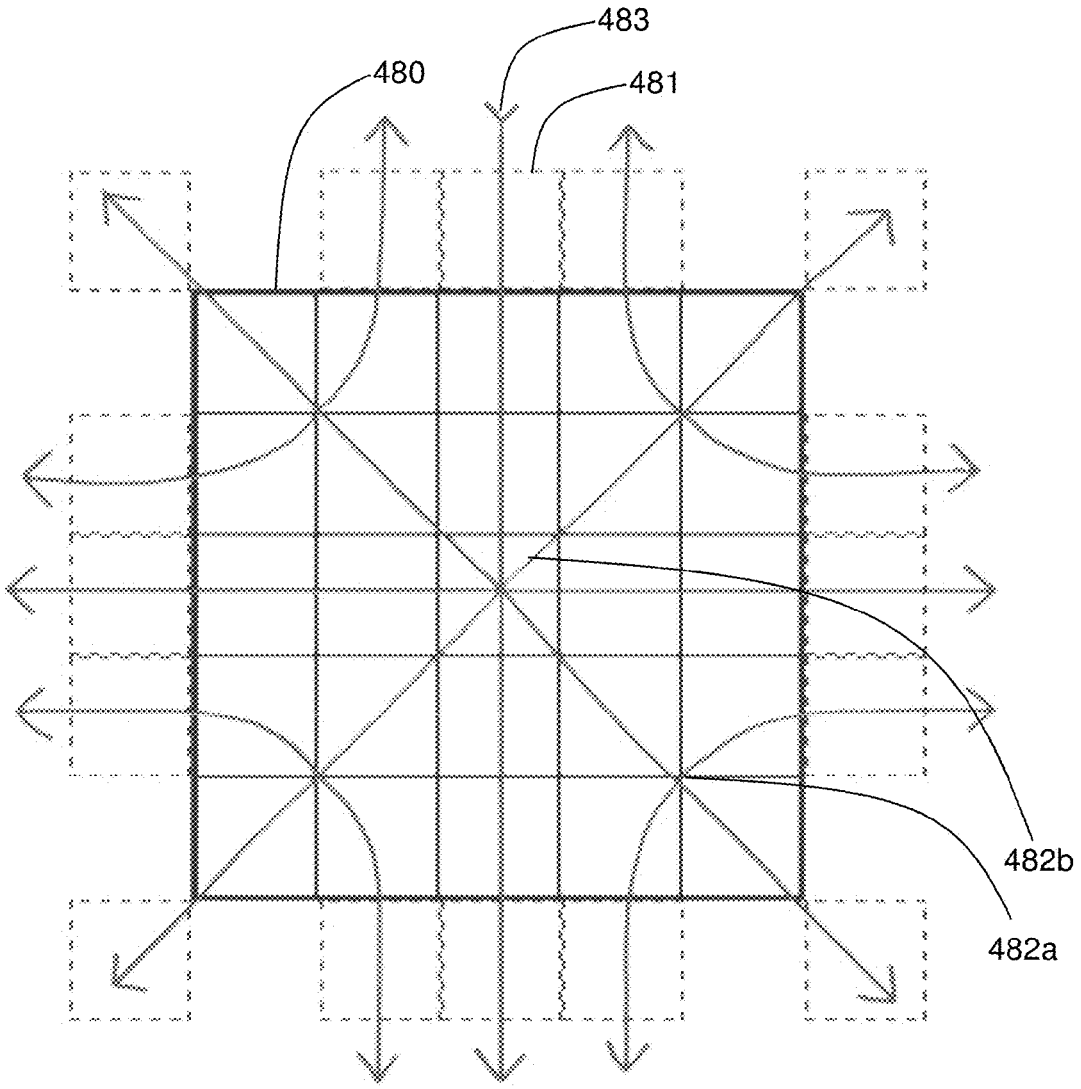
FIG. 29 shows a 5×5 win window with multiple branching and a multiple direction consecutive reel stop.

Referring to FIG. 29, there is shown a 5×5 win window with multiple track branching and a multiple direction consecutive reel stop. The illustrative single reel embodiment includes a 5×5 win window layout 480, a consecutive reel stop 481, an irregular track shape 482 that includes tracks 482*a*-482*b*, a top center track starting point 483 and no overlapping track. The extensive track branching starts at the first branch location 482*b* and is then divided into seven branches and includes a secondary branching at illustrative branching location 482*a*.

Figure 30:
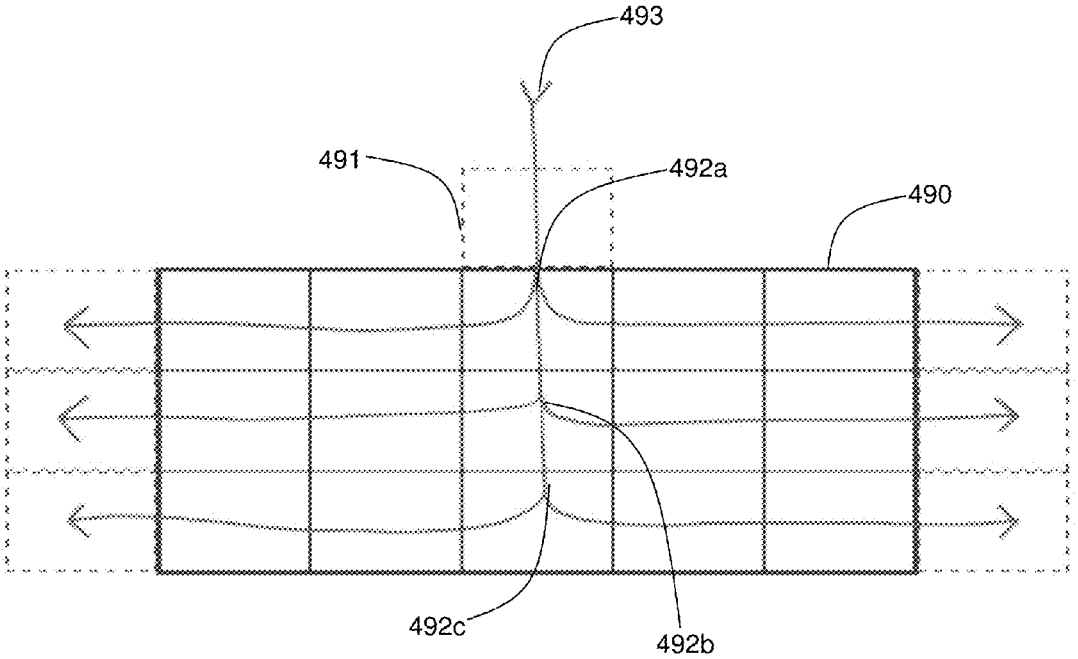
FIG. 30 shows a 3×5 win window with multiple central branches and a consecutive reel stop.

Referring to FIG. 30, there is shown a 3×5 win window with multiple central branches and a consecutive reel stop. The illustrative single reel embodiment includes a 3×5 win window layout 490 with a consecutive reel stop 491, an irregular track shape 492 that includes branch locations 492*a*, 492*b* and 492*c*, a top center track starting point 493, no overlapping track and extensive track branching.

Figure 31:
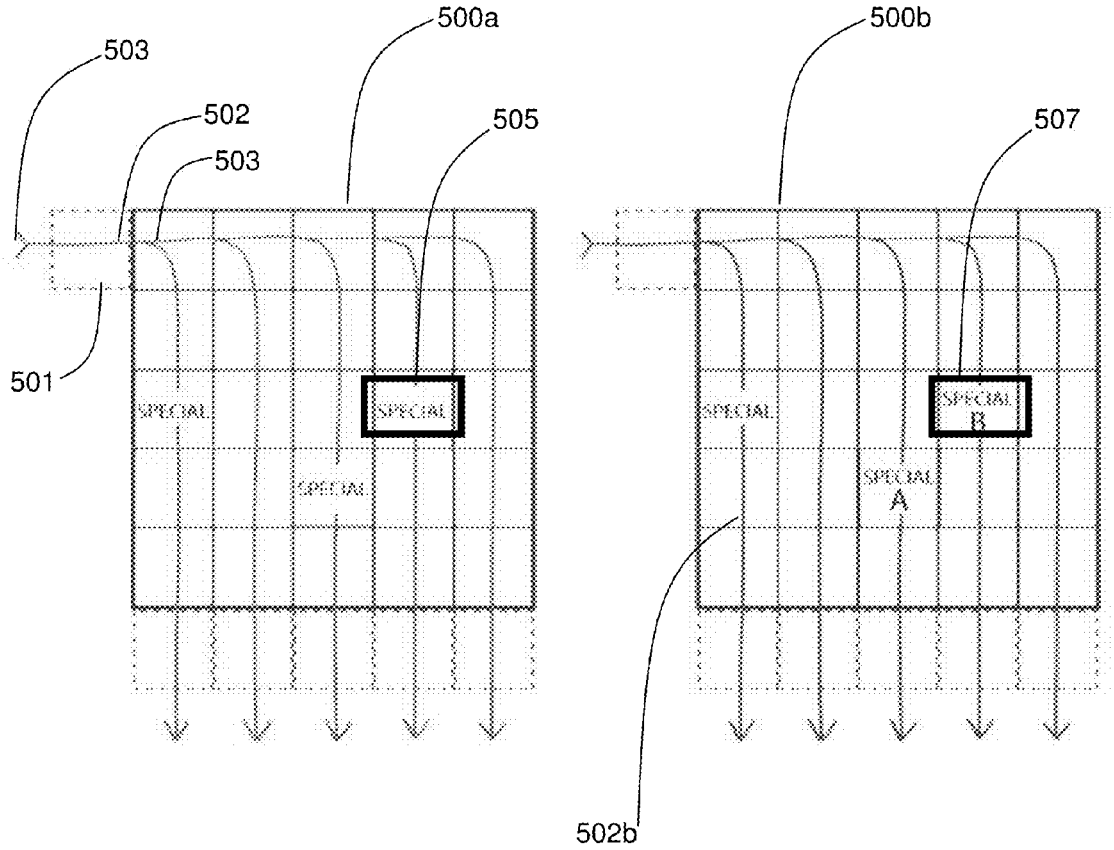
FIG. 31 shows a 5×5 win window with multiple vertical branches, a consecutive reel stop, special symbols and a bonus window with multiple vertical branches, a consecutive reel stop and transformative special symbols.

Referring to FIG. 31, there is shown a 5×5 win window with multiple vertical branches, a consecutive reel stop, special symbols and a bonus window with multiple vertical branches, a consecutive reel stop and transformative special symbols. More specifically, the primary game has a single reel embodiment that includes a 5×5 win window layout 500*a*, a consecutive reel stop 501, an irregular branching track shape 502, a top left track starting point 503, no overlapping track, and track branching. By way of example and not of limitation, the starting point 503 is followed by four track branch points. The illustrative track 502 includes at least one special feature symbol 505 that may land in the win window 500. If one or more of these special feature symbols land in the win window 500, then the primary game makes a determination whether to transform the symbol. The win window 500*b* presents and illustrative transformation, in which the special symbol 505 from win window 500*a* is transformed to another symbol 507. These determinations may be made individually, or on a case-by-case basis with separate determinations for each special feature symbol, thereby providing multiple outcomes for illustrative single reel game.

Figure 32:
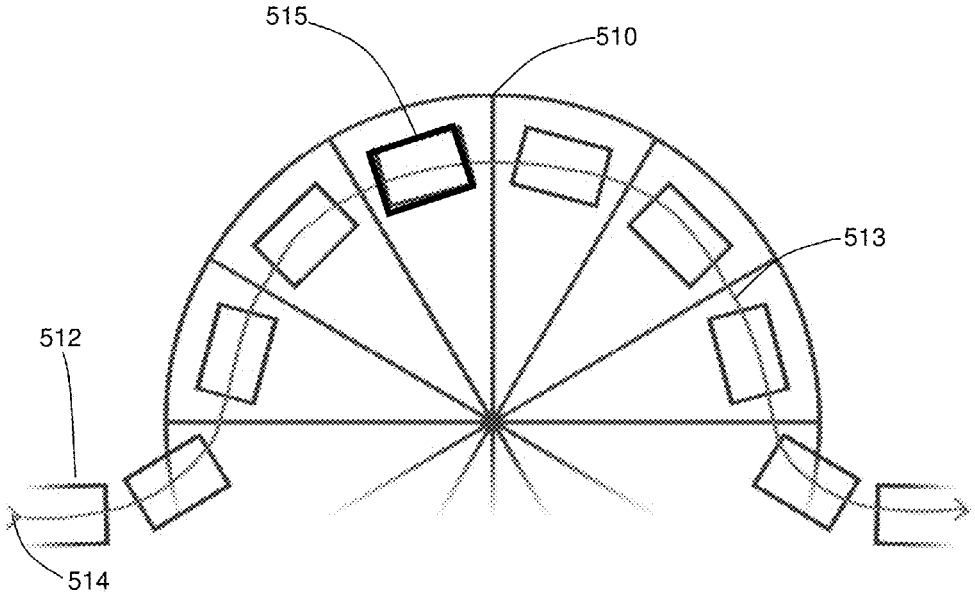
FIG. 32 shows a roulette style win window with a consecutive reel stop.

Referring to FIG. 32, there is shown a roulette style win window with a consecutive reel stop. More specifically, the illustrative single reel game includes a win window 510 having an irregular disc shaped layout with a consecutive reel stop 512, an irregular track shape 513, a left starting point 514, no overlapping track and no track branching. In this illustrative embodiment, the illustrative single reel embodiment may be used to populate a bonus disk or feature disk for a primary game. The illustrative single reel bonus game is configured to follow the edge of a disk graphic. The symbols 515 that land in the win window could be evaluated using a special win line, or any other such form of win evaluation. In one embodiment, the graphic of the disk may be rotated during the reel spin to correspond with the motion of the single reel symbols, giving the appearance that the symbols are part of the disk. This game mechanic provides a different player experience than that of a standard bonus wheel, because the single reel bonus may continue to show a different set of symbols in the win window while spinning for an indefinite spin length time. In contrast, a wheel can only spin after an event triggers the wheel and can only spin for a period of time before stopping. In this illustrative embodiment, the wheel spin may be operating continuously during the primary game session and a feature symbol of the primary game may pause the reel spin, and a winning combination in the primary game may trigger the bonus reel to pause after a particular period of time.

Figure 33:
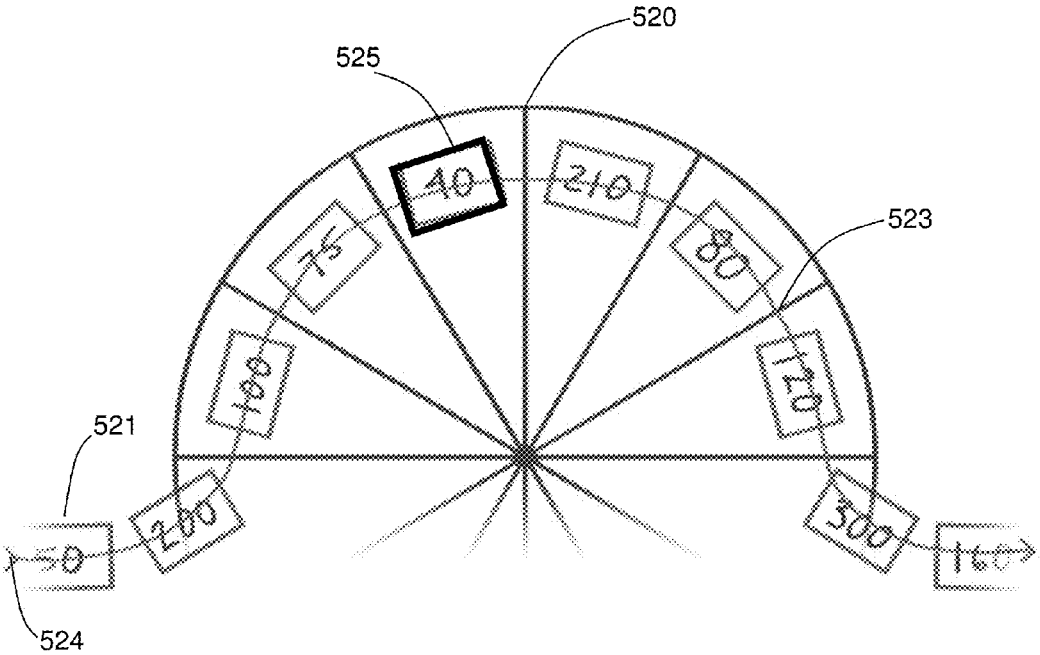
FIG. 33 shows another roulette style win window with a consecutive reel stop.

Referring to FIG. 33, there is shown another illustrative a roulette style win window with a consecutive reel stop. The illustrate single reel game includes an disk shaped win window 520 shaped, a consecutive reel stop 521, an irregular track shape 523 with a left starting point 524, no overlapping track and no track branching. This illustrative embodiment is similar to FIG. 32 with the difference being that the single reel embodiment includes credit values such as credit value reel stop 525 displaying 40 credits, while FIG. 32 presents symbols 515.

Figure 34:
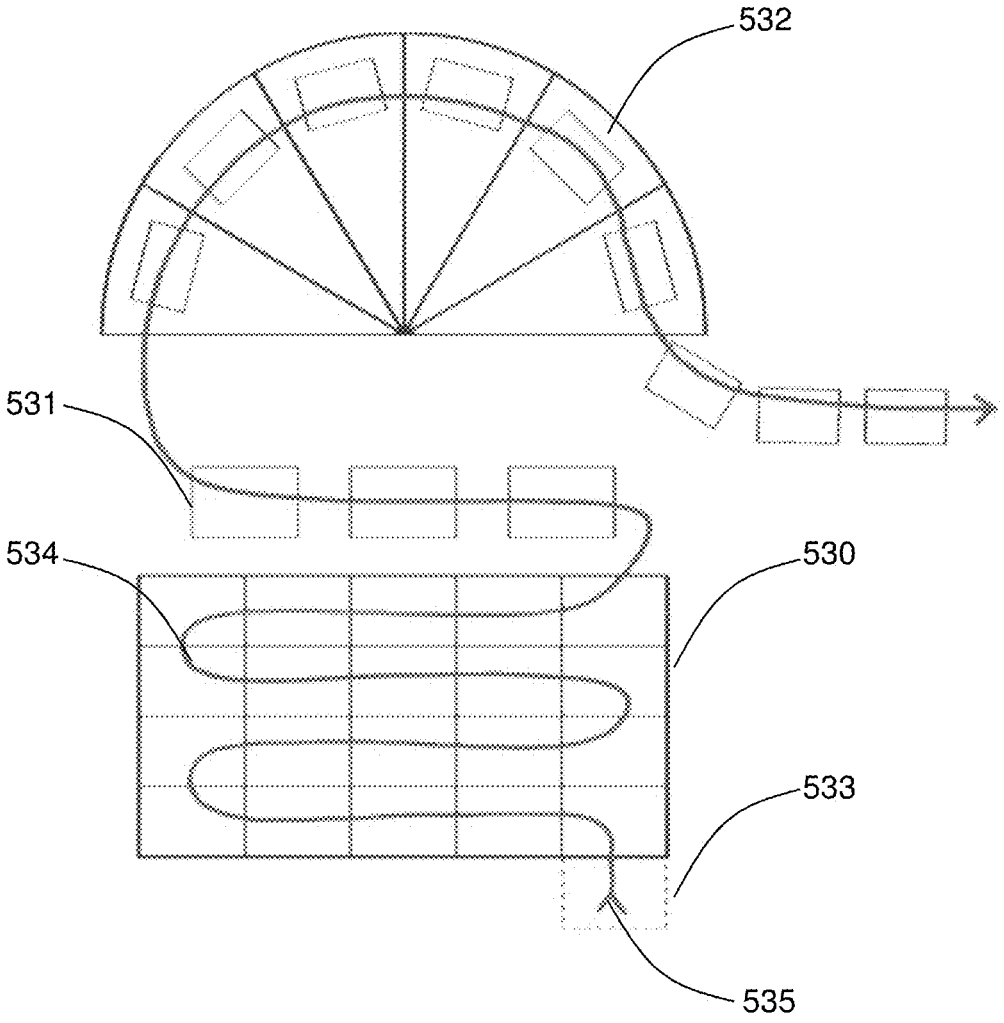
FIG. 34 shows a 4×5 win window with a three window bonus section and a six segment semi-circle bonus window.

Referring to FIG. 34, there is shown a 4×5 win window with a three window bonus section and a six segment semi-circle bonus window. More specifically, the illustrative embodiment includes an irregular 4×5 win window layout 530 with a feature area 531, a disk area 532, and a consecutive reel stop 533. Additionally, the illustrative embodiment includes an irregular track shape 534 that horizontal snakes across the win window 530, the feature pass area 531 and a disk pass area 532. A lower right track starting point 535, no overlapping track and no track branching are also presented. This illustrative embodiment shows how the single reel may be used as a method to populate a primary game (or base game). Additionally, the single reel embodiment may also be used as a feature game mechanic and for a bonus event. In the illustrative embodiment, the first part of the single reel track 534 populates the standard 4×5 portion of the win window 530. The single reel track 534 then proceeds through a feature area 531, and continues on to populate the bonus disk area 532. The base game feature enables a determination to be made of which three feature positions to activate at the beginning of the game session. Subsequently, the single reel game is initiated and the single reel spin lands so the symbols that are in the active feature position are designated as the transforming symbol for that game session. Some or all of the symbols in the main 4×5 win window area that match the symbol in the activated feature position are then transformed into a helpful symbol, e.g. wild, multiplier, and other such symbols. The illustrative bonus game may operate in a manner consistent with the single reel embodiments presented above in FIGS. 19, 20, 32 and 33.

Figure 35:
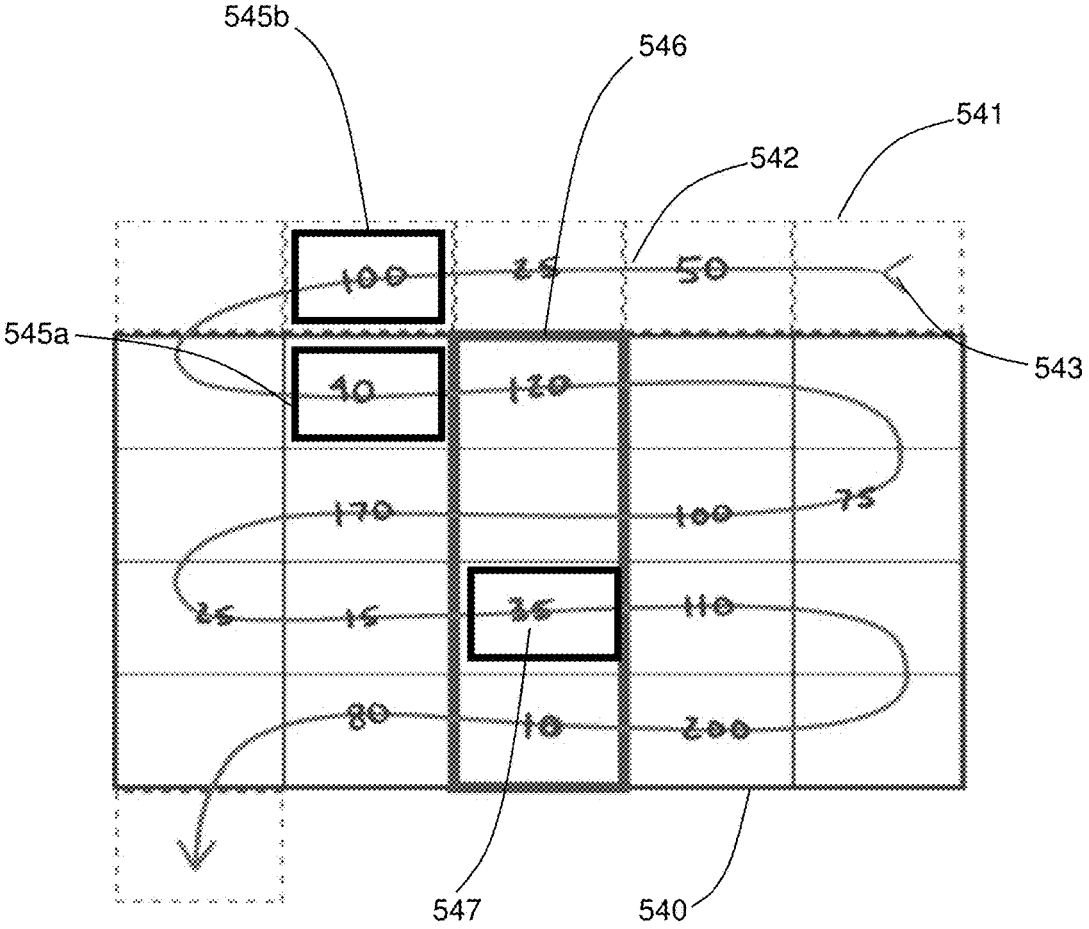
FIG. 35 shows 4×5 win window containing a 4×1 bonus central window.

Referring to FIG. 35, there is shown a 4×5 win window that includes a 4×1 bonus central window. More specifically, the illustrative single reel embodiment includes a 4×5 win window layout 540 with non-consecutive reel stop population 541, a horizontal snake track shape 542, an upper right track starting point 543, no overlapping track and no track branching. In this illustrative embodiment, an illustrative bonus game may also use the single reel outcome; the bonus game outcome is presented in vertical win window 546. In the primary single reel game, the track 542 includes illustrative credit values 545*a* and 545*b*. For the primary game session, the single reel spins and then stops, and the values that land in the vertical win window 546 are awarded to the player 547 as a "bonus." Thus, a separate bonus game is not initiated—the "embedded" bonus game part of the primary game session and has a vertical payline. The reels in the illustrative single reel embodiment may include other symbols that award more bonus spins, multiplier spins, and additional bonus event triggers that will readily suggest themselves to those of ordinary skill in the art.

Figure 36:
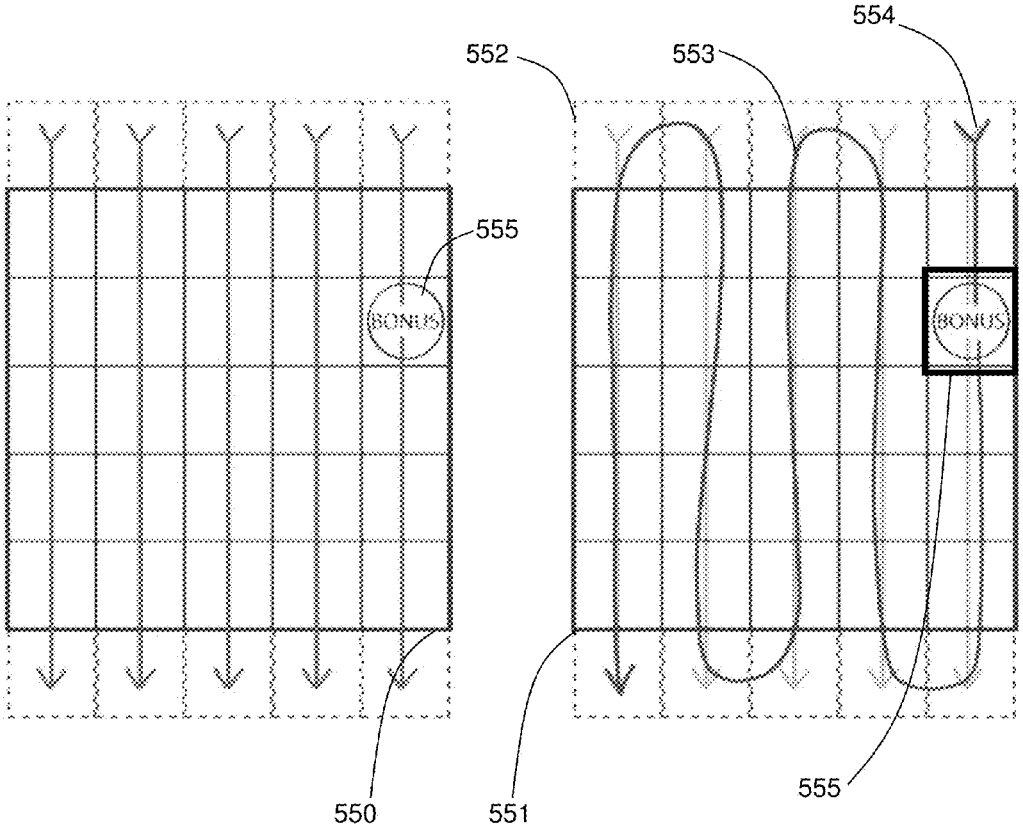
FIG. 36 shows a traditional 5×5 multi-reel slot window with an overlay single reel 5×5 bonus window with special symbols and vertical non-consecutive reel stop population.

Referring to FIG. 36, there is shown a traditional 5×5 multi-reel slot window 550 with an overlay single reel 5×5 bonus window 551 with special symbols and a vertical non-consecutive reel stop population. In this illustrative single reel bonus game embodiment, the single reel includes a 5×5 win window layout 551 includes a non-consecutive reel stop population 552, a vertical snake track shape 553, an upper right track starting point 554, no overlapping track and no track branching. The illustrative embodiment shows how the single reel may be applied as a bonus game to a standard multiple reel game. By way of example and not of limitation, a bonus triggering symbol 555 is presented on the primary multiple reel game that has landed in the win window 550; and the bonus symbol 555 may be extended to the single reel bonus game in win window 551 so that and the primary game awards one or more free spins to the single reel bonus game before returning to the standard multiple-reel primary game.

Figure 37:
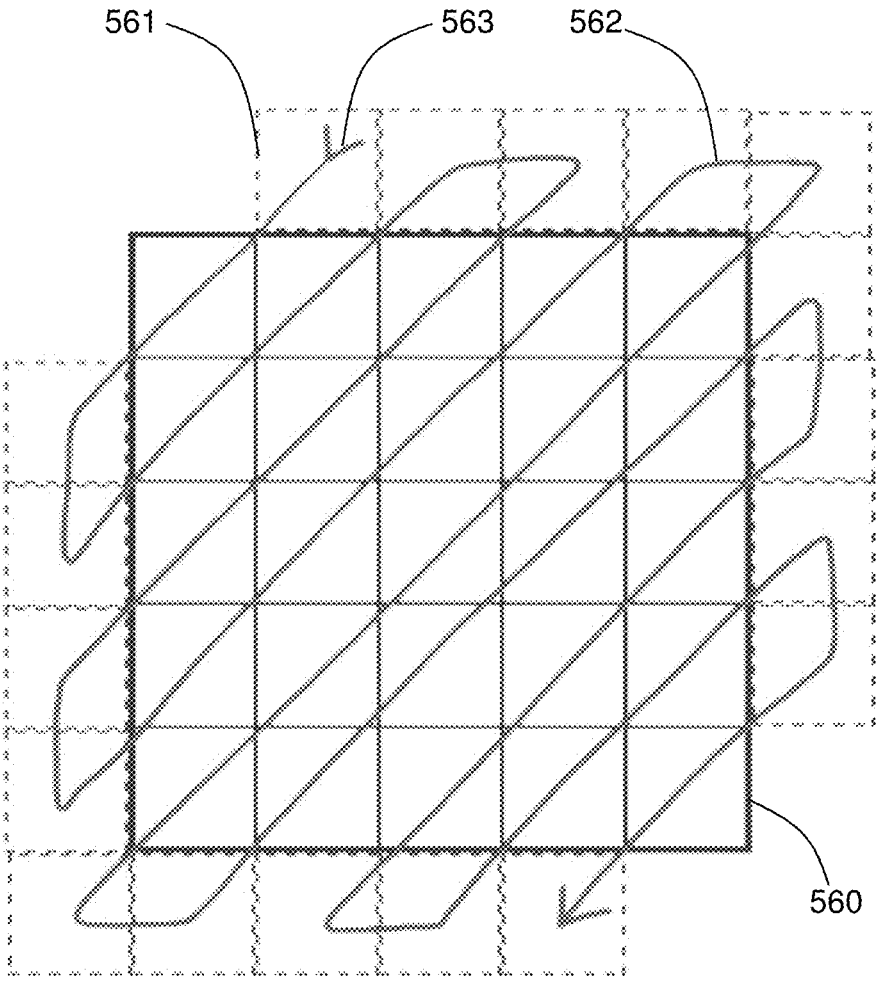
FIG. 37 shows a 5×5 win window having a diagonal non-consecutive reel stop population.

Referring to FIG. 37, there is shown a 5×5 win window having a diagonal non-consecutive reel stop population. More specifically, the illustrative single reel includes a 5×5 win window layout 560, a non-consecutive reel stop population 561, an irregular track shaped as a diagonal snake 562, an upper left track starting point 563, no overlapping rack and no track branching.

Figure 38:
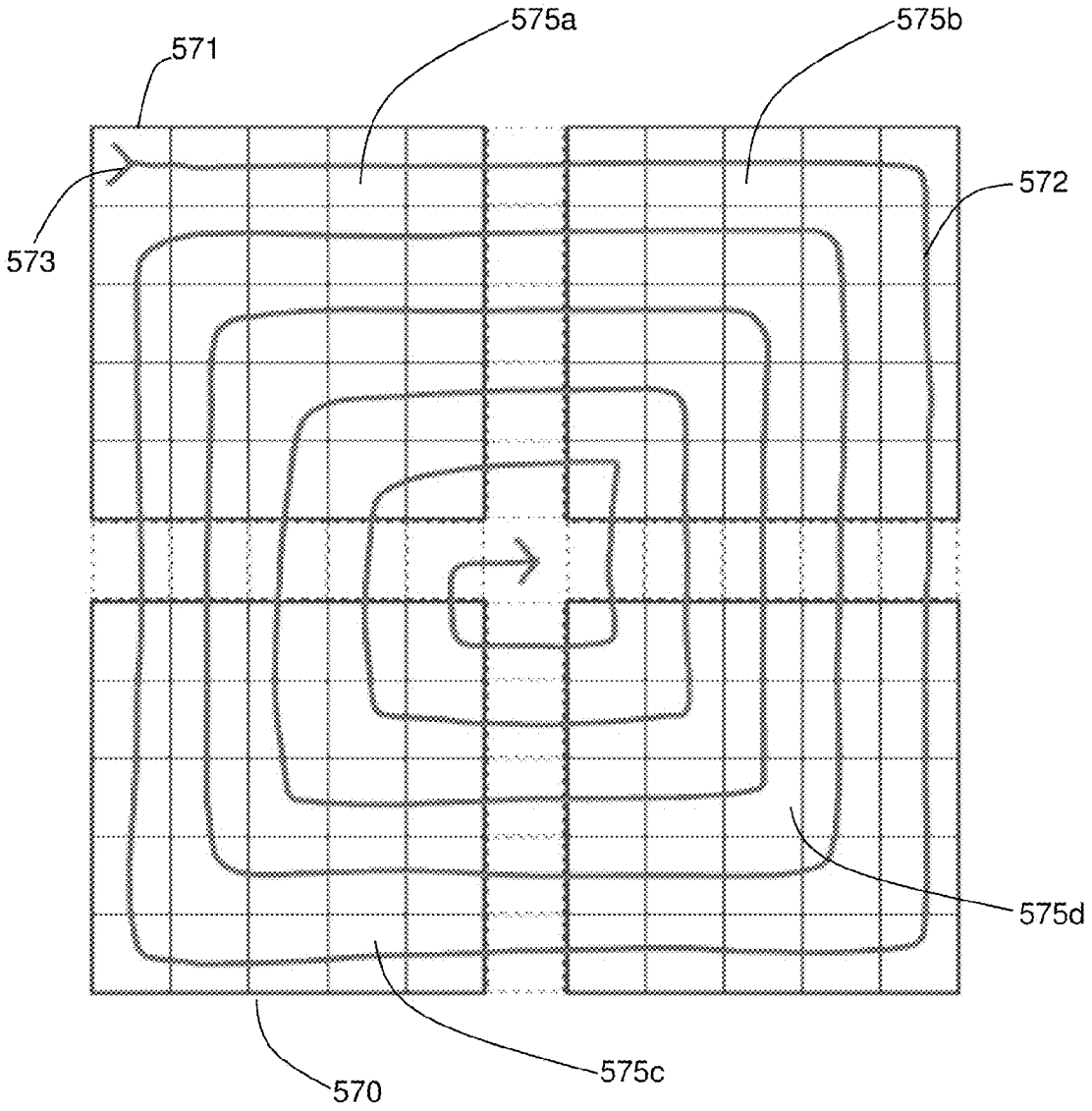
FIG. 38 shows four independent 5×5 win windows with a circular non-consecutive reel stop population in a continuous non-sequential manner.

Referring to FIG. 38, there is shown four independent 5×5 win windows with a circular non-consecutive reel population in a continuous non-sequential manner. More specifically, the single reel embodiment includes an irregular grouping of 5×5 win windows 570, a consecutive reel stop 571, an inward spiral track shape 572, an upper left track starting point 573, an overlapping track and no track branching. In this illustrative embodiment example, the win window being populated by the single reel is divided into multiple sections 575*a*, 575*b*, 575*c*, and 575*d*. In the illustrative game, the player is allowed to choose which section would be evaluated for wins before each spin. In another illustrative embodiment, the player's bet determines which sections are evaluated: bet level 1 results in win evaluation of one section, bet level 2 results in the win evaluation of two sections, and so on.

The various illustrative single reel game embodiments presented above may be used in Class II and Class III electronic gaming machines or devices. In general, the single reel game(s) described herein may operate as a Class II game, a Class III game, or a combination thereof. Thus, the primary game sessions or bonus game sessions of the Class II or Class III games may deploy one or more of the single reel embodiment presented above.

The Class II gaming devices includes bingo and bingo-like games such as pulltab games. Electronic Class II games may be played on a networked gaming machine. Class II gaming machines are networked to a Class II game service and to a player tracking server.

Slot machines which operate in Class II jurisdictions may also be known as Video Lottery Terminals (VLT). A VLT plays a virtual lottery game. In some VLT versions, the machine receives a virtual scratch-off ticket. The video reels spin and reveal results consistent with whatever is on the ticket. In other versions, the machine plays a virtual bingo game and receives a bingo card from a central computer, and various linked terminals play the bingo game to conclusion. The video reels spin and reveal results consistent with whatever occurred in the bingo game. VLTs are computer terminals linked to central deterministic computers and the games necessarily are generated and played by a Random Number Generator.

Additionally, Class II gaming devices utilize the game of bingo as the basis for determining a winning outcome where the ball draw is performed remotely by a network or central determination server. Class II gaming systems are commonly referred to as central determination systems wherein pools and sub-pools of game outcomes are determined by a central server or gaming device, and distributed amongst a set of networked gaming devices. The distribution step may be on demand, such as when a gaming device receives a game request, or sets of game outcomes may be distributed to the various networked gaming devices, in which case the game processor of the requesting gaming device may select a game outcome from the set of game outcomes.

The single reel game embodiments presented above may also be utilized in Class III games, which are a separate category of gaming machines that are subject to stricter approval and regulation. Generally, Class III games include a gaming machine that has a true random number generator. By way of example, Class III games are networked to a player tracking server, but are not networked for the primary game session, and the primary game session in Class III gaming is typically provided in a stand-alone mode.

Class III gaming devices use an individual internal Random Number Generator (RNG) to determine wins and losses. Every Class III reel spin is separate from any other and payable immediately. The Random Number Generator is generally a program or algorithm which resides in the Central Processing Unit of the gaming device as shown above in item 121 in FIG. 1F.

The single reel embodiments presented above may be applied to primary games and to bonus games. Bonus games may comprise any type of game that is entered upon the occurrence of a selected event or outcome in the primary game. Bonus games may award players with a "progressive jackpot" award that is funded, at least in part, by a percentage of the coin-in from the gaming device or a plurality of participated gaming devices.

The single reel game presented herein may also be configured to drive a single hand video poker game or to perform a bonus game session. Video draw poker has been played in gaming establishments for many years. In conventional video draw poker, a single player does not play against a dealer or other players, but rather attempts to achieve a highest possible poker-hand ranking. They player is dealt five face-up cards from a standard 52-card deck, the player is allowed to discard and replace unwanted cards with replacement cards from the deck, resulting in a final card hand. The game then determines a poker-hand ranking of the final card hand and provides an award based on a pay table. The pay table includes a list of winning poker-hand rankings and the award for each ranking. The single reel game may also be configured to drive a multi-hand video poker game as a primary game or to provide a bonus game.

By way of example and not of limitation, the illustrative single reel game may be configured to drive a Texas hold'em video poker game. In standard Texas hold'em, the player is dealt two cards face down from a standard 52-card deck. These cards are called the "hole" or "pocket" cards. The hand begins with a pre-flop betting round. After the pre-flop betting round, the dealer deals three face-up community cards or "flop" cards, which is then followed by a second betting round. After the flop betting round ends, a single community card (called the turn) is dealt. This is followed by a third betting round. A final single community card (called the river) is then dealt, followed by a fourth betting round. This is followed by the showdown, where the best five-card poker hand is made from the seven cards comprising his two hole cards and the five community cards.

The single reel game may also be configured to present a Keno game, a lottery game, a bingo game, a pull-tab game, and other such games of chance.

It is to be understood that the detailed description of illustrative embodiments are provided for illustrative purposes. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A computer implemented method for operating a single reel game that uses a single reel in a single reel electronic gaming device having a display operable to present a win window, one or more tracks operable to display a plurality of single reel symbols in a spatial order, a memory storing one or more gaming operations, a monetary input component, and one or more processing units configured to perform the single reel game operations the method comprising:

generating on the gaming device a single reel that includes a plurality of single reel symbols that are adjacent to one another;

displaying on a display one or more single reel symbols on a track in a spatial order;

stopping the single reel at a starting reel stop, that provides a reference point for stopping the single reel, when the single reel is in motion;

displaying on the display in a win window a plurality of the single reel symbols;

displaying on the display one or more single-reel symbols outside the win window;

overlaying a payline on the symbols within the win window;

listing a plurality of payout prizes in a paytable that includes payouts for each combination of symbols along the payline; and awarding a prize when the single reel game symbols along the payline match the paytable combination of symbols.

2. The method of operating the game of claim 1 wherein the gaming device includes a network card that is communicatively coupled to a network and the gaming device is configured to communicate with the network.

3. The method of operating the game of claim 1 further comprising enabling a consecutive reel stop function, in which all the symbols in the win window are populated by consecutive stops from the single reel game.

4. The method of operating the game of claim 1 further comprising enabling a nonconsecutive reel stop population function.

5. The method of operating the game of claim 1 wherein the track further comprises an overlapping track, in which the single reel follows the track that overlaps at least one reel stop.

6. The method of operating the game of claim 1 wherein the track further comprises at least one track branch point, in which the track branches into two branched tracks.

7. A gaming device that uses a single reel, the gaming device-comprising:

a display operable to present a win window;

one or more tracks operable to display a plurality of single reel symbols in a spatial order;

a memory storing one or more gaming operations;

a monetary input component, and at least one logic component operative to:

generate on the gaming device a single reel having a plurality of symbols that are adjacent to one another;

display on a display one or more single reel symbols on a track in a spatial order;

stop the single reel at a starting reel stop, that provides a reference point for stopping the single reel, when the single reel is in motion;

displaying on the display a plurality of the single reel symbols that fall within a win window;

display on the display one or more single-reel symbols outside the win window;

overlay a payline on the symbols within the win window; and list a plurality of payout prizes in a paytable that lists a plurality of payout prizes for each combination of symbols along the payline.

8. The gaming device of claim 7 wherein the logic component is operative to award a prize when the single reel game symbols along the payline match the paytable combination of symbols.

9. The gaming device of claim 8 further comprising a network interface card that is communicatively coupled to a network and the gaming device is configured to communicate with the network.

10. The gaming device of claim 7 further comprising a consecutive reel stop, in which all the symbols in the win window are populated by consecutive stops from the single reel game.

11. The gaming device of claim 7 further comprising a non-consecutive reel stop population.

12. The gaming device of claim 7 wherein the track further comprises an overlapping track, in which the single reel follows the track that overlaps at least one reel stop.

13. The gaming device of claim 7 wherein the track further comprises at least one track branch point, in which the track branches into two branched tracks.

14. A gaming system that uses a single reel, the gaming system comprising:

a gaming server that includes:

a memory storing one or more gaming operations;

a first communication module:

a monetary input component;

one or more first processing units;

a single reel module that generates a single reel that includes a plurality of symbols that are adjacent to one another;

one or more tracks operable to display a plurality of single reel symbols in a spatial order;

a starting reel stop that provides a reference point for stopping the single reel, when the single reel is in motion; and a paytable that lists a plurality of payout prizes for each combination of symbols along the payline; and a gaming client that includes, a second communication module;

one or more second processing units;

a game session input that is communicated to the gaming server that stops the single reel at the starting reel stop;

a display that presents a single reel game outcome, wherein one or more single-reel symbols are outside the win window;

a payline that is overlaid on the symbols within the win window; and a prize awarded when the single reel game symbols along the payline match the paytable combination of symbols.

15. The gaming system of claim 14, wherein the starting reel stop is stored by the game server.

16. The gaming system of claim 14, wherein the gaming server further comprises a consecutive reel stop, in which all the symbols in the win window are populated by consecutive stops from the single reel game.

17. The gaming system of claim 14, wherein the gaming server further comprises a non-consecutive reel stop population.

18. The gaming system of claim 14 wherein the track further comprises an overlapping track, in which the single reel follows the track that overlaps at least one reel stop.

19. The gaming system of claim 14 wherein the track further comprises at least one track branch point, in which the track branches into two branched tracks.

* * * * *